US010859933B2

(12) United States Patent
Kinumatsu et al.

(10) Patent No.: US 10,859,933 B2
(45) Date of Patent: Dec. 8, 2020

(54) MAGNETIC TONER

(71) Applicant: CANON KABUSHIKI KAISHA, Tokyo (JP)

(72) Inventors: Tetsuya Kinumatsu, Mishima (JP); Kosuke Fukudome, Tokyo (JP); Yusuke Hasegawa, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/584,346

(22) Filed: Sep. 26, 2019

(65) Prior Publication Data

US 2020/0103776 A1 Apr. 2, 2020

(30) Foreign Application Priority Data

Oct. 2, 2018 (JP) ..... 2018-187459

(51) Int. Cl.
*G03G 9/08* (2006.01)
*G03G 9/087* (2006.01)
*G03G 9/083* (2006.01)

(52) U.S. Cl.
CPC ..... *G03G 9/08755* (2013.01); *G03G 9/0821* (2013.01); *G03G 9/0835* (2013.01); *G03G 9/0836* (2013.01); *G03G 9/0837* (2013.01); *G03G 9/0838* (2013.01)

(58) Field of Classification Search
CPC ..... G03G 9/08755; G03G 9/0835; G03G 9/0836; G03G 9/0821
USPC ..... 430/109.4, 111.4
See application file for complete search history.

(56) References Cited

U.S. PATENT DOCUMENTS 6,586,151 B1 7/2003 Naka et al.
6,703,176 B2 3/2004 Naka et al.
6,803,164 B2 10/2004 Mizoo et al.
6,953,646 B2 10/2005 Doujo et al.
(Continued)

FOREIGN PATENT DOCUMENTS

DE 10 2017 130 458 6/2018
EP 1 684 123 7/2006
(Continued)

OTHER PUBLICATIONS

U.S. Appl. No. 16/583,945, Kosuke Fukudome, filed Sep. 26, 2019.
(Continued)

*Primary Examiner* — Mark A Chapman
(74) *Attorney, Agent, or Firm* — Venable LLP

(57) ABSTRACT

A magnetic toner comprising a magnetic toner particle including a binder resin, a magnetic body and a crystalline polyester, wherein the dielectric loss tangent at 100 kHz is $1.0\times10^{-2}$ or more, a variation coefficient CV3 of an occupied area ratio of the magnetic body when a cross section of the magnetic toner particle is divided by a square grid having a side of 0.8 μm in cross-sectional observation of the magnetic toner particle using a transmission electron microscope TEM is from 30.0% to 80.0%, and where a storage elastic modulus of the magnetic toner at 40° C. is taken as E'(40) [Pa] and a storage elastic modulus of the magnetic toner at 85° C. is taken as E'(85) [Pa], the following formulas (1) and (2) are satisfied:

$$E'(85)\leq5.5\times10^{9} \quad (1)$$

$$[E'(40)-E'(85)]\times100/E'(40)\geq30 \quad (2).$$

9 Claims, 2 Drawing Sheets

(56) References Cited

U.S. PATENT DOCUMENTS

| | | | |
|---|---|---|---|
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,704,659 | B2 | 4/2010 | Ogawa et al. |
| 7,678,524 | B2 | 5/2010 | Hasegawa et al. |
| 7,811,734 | B2 | 10/2010 | Ogawa et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,492,064 | B2 | 7/2013 | Jugle et al. |
| 8,603,712 | B2 | 12/2013 | Aoki et al. |
| 8,614,044 | B2 | 12/2013 | Matsui et al. |
| 8,741,519 | B2 | 6/2014 | Watanabe et al. |
| 8,846,284 | B2 | 9/2014 | Kinumatsu et al. |
| 8,918,035 | B2 | 12/2014 | Hasegawa et al. |
| 9,029,055 | B2 | 5/2015 | Aoki et al. |
| 9,034,549 | B2 | 5/2015 | Shiotari et al. |
| 9,040,216 | B2 | 5/2015 | Fukudome et al. |
| 9,097,997 | B2 | 8/2015 | Nomura et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,429,860 | B2 | 8/2016 | Kinumatsu et al. |
| 9,454,096 | B2 | 9/2016 | Hasegawa et al. |
| 9,470,993 | B2 | 10/2016 | Nishikawa et al. |
| 9,594,323 | B2 | 3/2017 | Fujikawa et al. |
| 9,606,462 | B2 | 3/2017 | Nomura et al. |
| 9,625,841 | B2 | 4/2017 | Hiroko et al. |
| 9,625,842 | B2 | 4/2017 | Uratani et al. |
| 9,625,844 | B2 | 4/2017 | Kaya et al. |
| 9,658,548 | B2 | 5/2017 | Magome et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,804,514 | B2 | 10/2017 | Suzumura et al. |
| 9,804,519 | B2 | 10/2017 | Suzumura et al. |
| 9,811,016 | B2 | 11/2017 | Aoki et al. |
| 9,823,595 | B2 | 11/2017 | Toyoizumi et al. |
| 9,841,692 | B2 | 12/2017 | Hasegawa et al. |
| 9,857,713 | B2 | 1/2018 | Kosaki et al. |
| 9,869,943 | B2 | 1/2018 | Aoki et al. |
| 9,927,728 | B2 | 3/2018 | Arimura et al. |
| 9,946,179 | B2 | 4/2018 | Arimura et al. |
| 9,946,181 | B2 | 4/2018 | Hasegawa et al. |
| 9,964,874 | B2 | 5/2018 | Suzumura et al. |
| 9,964,881 | B2 | 5/2018 | Ikejiri et al. |
| 9,971,262 | B2 | 5/2018 | Hasegawa et al. |
| 9,971,263 | B2 | 5/2018 | Fukudome et al. |
| 9,971,264 | B2 | 5/2018 | Sano et al. |
| 10,012,923 | B2 | 7/2018 | Sano et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,921 | B2 | 5/2019 | Ohmori et al. |
| 10,310,397 | B2 | 6/2019 | Sano et al. |
| 10,409,180 | B2 | 9/2019 | Koji et al. |
| 10,545,420 | B2 | 1/2020 | Kinumatsu et al. |
| 2009/0186288 | A1 | 7/2009 | Hirata et al. |
| 2012/0107740 | A1 | 5/2012 | Jugle et al. |
| 2016/0378003 | A1 | 12/2016 | Arimura et al. |
| 2019/0155181 | A1 | 5/2019 | Nagashima et al. |
| 2019/0346794 | A1* | 11/2019 | Sudo ..... G03G 15/2057 |

FOREIGN PATENT DOCUMENTS

| | | | |
|---|---|---|---|
| JP | 2003195560 | A | 7/2003 |
| JP | 2006243593 | A | 9/2006 |
| JP | 2012093752 | A | 5/2012 |
| JP | 2013137420 | A | 7/2013 |

OTHER PUBLICATIONS

U.S. Appl. No. 16/701,260, Koji Nishikawa, filed Dec. 3, 2019.
U.S. Appl. No. 16/701,292, Tetsuya Kinumatsu, filed Dec. 3, 2019.
U.S. Appl. No. 16/701,412, Kosuke Fukudome, filed Dec. 3, 2019.

* cited by examiner

MAGNETIC TONER

BACKGROUND OF THE INVENTION

Field of the Invention

The present invention relates to a magnetic toner for use in a recording method using electrophotography, electrostatic recording, or toner jet recording.

Description of the Related Art

In recent years, a demand has been created for means for outputting images in a wide range of fields from offices to homes and in various environments, and high image quality is required under all of these circumstances. Meanwhile, downsizing and energy saving are also required for the image output apparatus itself.

In order to save energy, it is important that the toner be sufficiently fixed at a low temperature.

The usage of a crystalline polyester that becomes rapidly compatible with the binder resin of a toner and promotes the melt deformation of the toner particle in the toner, and the control of viscoelastic properties of the toner have been widely studied as means for improving the fixability. A crystalline polyester producing a high effect on low-temperature fixability has the property of easily becoming compatible with the binder resin in the vicinity of the melting point thereof, and the toner including the crystalline polyester is easily melted and deformed rapidly at the time of fixing. Therefore, the low-temperature fixability of the toner is improved by using the crystalline polyester. Japanese Patent Application Publication No. 2013-137420 proposes a toner including a crystalline polyester.

Meanwhile, miniaturizing a cartridge accommodating a developer is an effective means for reducing the image output apparatus in size. In this regard, a one-component development system is preferable to a two-component development system using a carrier, and a contact development system is preferable in order to obtain a high-quality image at the same time. Therefore, the one-component contact development system is an effective means for satisfying the miniaturization and high image quality.

In the one-component contact development system, a toner bearing member and an electrostatic latent image bearing member are arranged in contact with each other (contact arrangement). That is, these bearing members carry toner by rotation, and a strong shear force is applied in the contact portion, so the toner needs to have high durability in order to obtain a high-quality image.

With a toner having low durability, cracking and chipping of toner particle occur and the toner bearing member and the electrostatic latent image bearing member are contaminated which results in deterioration of image quality. In particular, when a chipped toner particle or a cracked toner particle adheres to the fixing roller, paper discharge failure occurs due to the occurrence of media winding.

A magnetic toner including a magnetic body (hereinafter, also simply referred to as toner) has a large density difference between the resin and the magnetic body, and when an external force is applied, the force is concentrated on the resin and displaced thereby cutting the resin. As a result, in particular, cracking and chipping of the toner particle are likely to occur.

When it is desired to perform a large number of image outputs in various usage environments, higher toner durability is required because an additional load is applied to the toner.

Japanese Patent Application Publication No. 2006-243593 proposes a toner including magnetic bodies.

Japanese Patent Application Publication No. 2012-93752 proposes a magnetic toner in which magnetic bodies are dispersed using an aggregation method. The manufacturing method thereof includes an aggregation step of aggregating fine particles to a toner particle diameter, and a coalescence step of coalescing the toner by melting the aggregates. In this method, it is easy to deform the toner shape and the flowability can be enhanced.

Meanwhile, in the one-component contact development system, charge application to a toner is mainly performed by triboelectric charging that uses rubbing between the toner and a triboelectric charge-providing member such as a developing sleeve. However, in a low-temperature and low-humidity environment where a toner is likely to be charged, there is a concern that the image quality may deteriorate due to the offset where the image is whitened. This is due to an electrostatic offset in which the toner adheres electrostatically to a fixing device when a charge-up occurs that greatly increases the charge quantity of the toner and an unfixed image passes through the fixing device. The electrostatic offset is particularly likely to occur in the one-component contact development system. In such a system, a shear force is easily applied to the toner, and the toner particle is easily cracked. Since the cracked toner particle is unevenly charged and easily charged up, the toner particle tends to adhere strongly to the fixing device.

A large number of methods have been proposed to adjust the charging performance of the toner and to suppress the charge-up by adding a conductive fine particle as an external additive to the toner particle or adjusting the magnetic bodies in order to solve this problem.

Japanese Patent Application Publication No. 2003-195560 proposes a toner in which the dielectric loss tangent is controlled by changing the surface treatment of the magnetic bodies.

SUMMARY OF THE INVENTION

In the toner disclosed in Japanese Patent Application Publication No. 2013-137420, the low-temperature fixability is improved, but the electrostatic offset is still a problem.

Problems associated with the toner using the manufacturing method disclosed in Japanese Patent Application Publication No. 2006-243593 are that it is difficult to increase the degree of circularity, and that in a system in which a shear force is applied, such as the one-component contact development system, the fusion of the toner is likely to occur. Furthermore, it was found that there are few locations where the binder resin is unevenly distributed like domains (hereinafter, also referred to as domains of binder resin) in a toner particle, the binder resin forms a fine network structure, and the connections between the binder resin portions become thin. As a result, the bond strength between the resin portions is reduced, and in a system in which a shear force is applied, there is a problem that the force cannot be absorbed and toner deterioration easily occurs.

Meanwhile, the toner disclosed in Japanese Patent Application Publication No. 2012-93752, similarly the toner disclosed in Japanese Patent Application Publication No. 2006-243593, has a structure in which the number of domains of the binder resin in the toner particle is small, and the bond strength between the resin portions is unlikely to increase. It was found that, as a result of this, in a system in which a shear force is applied, the force cannot be absorbed, and the toner deterioration is likely to occur. The resulting problem is that the broken toner fragments contaminate the fixing device, and fixing separability is reduced.

By contrast, in the toner in which the magnetic bodies are aggregated, cutting of the binder resin hardly occurs, but there is a problem that the tinting strength is lowered and the density of the output image is lowered due to the reduction of the surface area of the magnetic bodies. Further, in the toner in which the magnetic bodies are aggregated, the content ratio of the magnetic body tends to be different for each toner particle, and in particular, the magnetic body is difficult to introduce into a toner particle having a small diameter. As a result, when a large number of images are outputted, there is a problem that the image density decrease gradually occurs.

In addition, although the electrostatic offset of the toner disclosed in Japanese Patent Application Publication No. 2003-195560 is improved, a problem associated with this toner is that there is still room for improvement in terms of electrostatic offset in a more severe low-temperature environment, and in a system in which a shear force is applied, the force cannot be absorbed and toner deterioration easily occurs.

The present invention provides a magnetic toner that ensures excellent image quality in a system in which a strong shear force is applied to the toner, and that has strong resistance to environmental changes, excels in low-temperature fixability, and makes it possible to suppress electrostatic offset even under severe environments.

The inventors of the present invention have found that the above problems can be solved by controlling the dispersion state of magnetic bodies in the magnetic toner, and a storage elastic modulus and a dielectric loss tangent of the magnetic toner, and the present invention has been accomplished based on this finding.

Thus, the present invention provides a magnetic toner including a magnetic toner particle that includes a binder resin, a magnetic body, and a crystalline polyester, wherein a dielectric loss tangent of the magnetic toner at 100 kHz is 1.0×10' or more, in cross-sectional observation of the magnetic toner particle using a transmission electron microscope TEM, a variation coefficient CV3 of an occupied area ratio of the magnetic body when a cross section of the magnetic toner particle is divided by a square grid having a side of 0.8 μm is from 30.0% to 80.0%, and assuming that a storage elastic modulus at 40° C. is taken as E'(40) [Pa] and a storage elastic modulus at 85° C. is taken as E'(85) [Pa], the storage elastic moduli being obtained in a powder dynamic viscoelasticity measurement of the magnetic toner, the following formulas (1) and (2) are satisfied:

$$E'(85) \leq 5.5 \times 10^9 \quad (1)$$

$$[E'(40) - E'(85)] \times 100 / E'(40) \geq 30 \quad (2)$$

According to the present invention, it is possible to provide a magnetic toner that ensures excellent image quality in a system in which a strong shear force is applied to the toner, and that has strong resistance to environmental changes, excels in low-temperature fixability, and makes it possible to suppress electrostatic offset even under severe environments.

Further features of the present invention will become apparent from the following description of exemplary embodiments with reference to the attached drawings.

DESCRIPTION OF THE EMBODIMENTS

Figure 1:
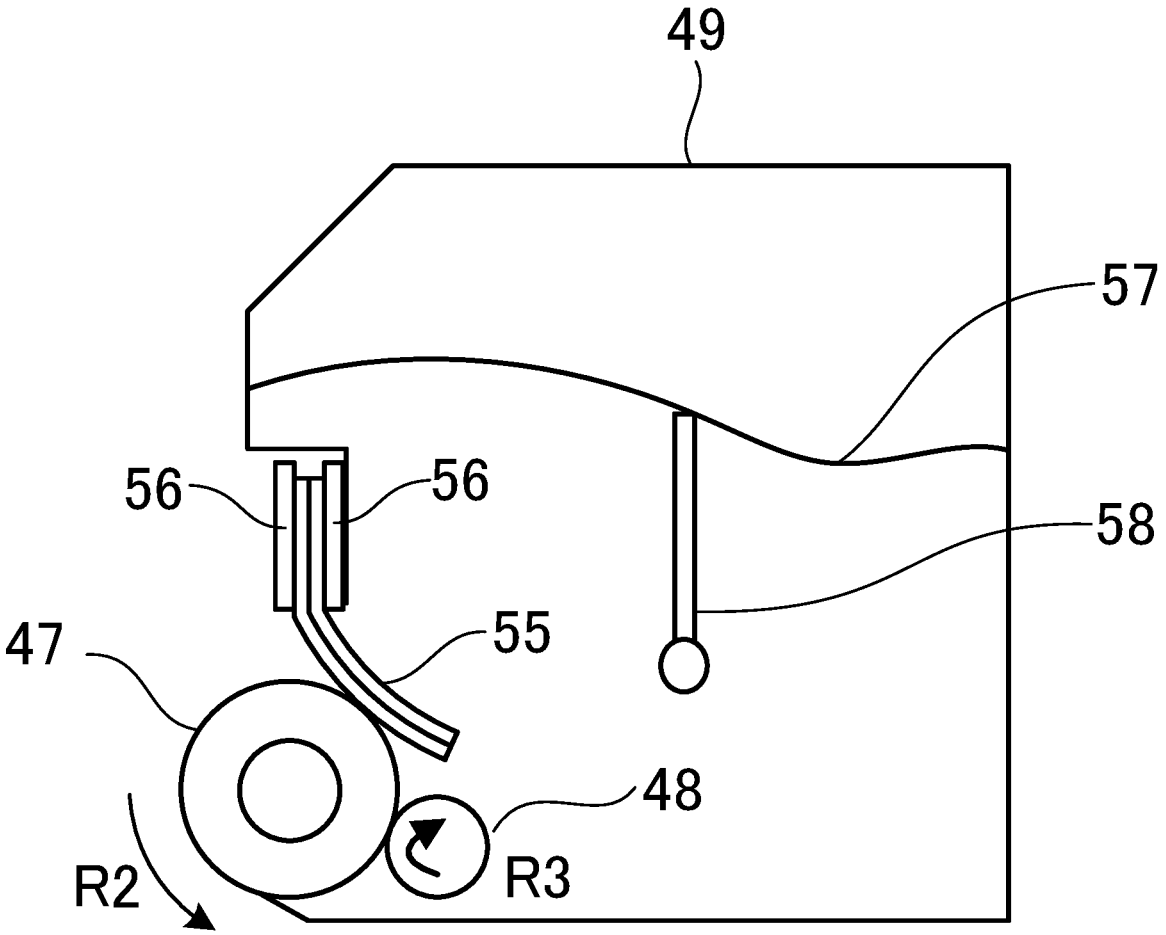
FIG. 1 is a schematic sectional view of a developing device.

In the present invention, the descriptions of "from XX to YY" or "XX to YY" representing a numerical range mean a numerical range including the lower limit and the upper limit which are endpoints, unless otherwise noted.

Further, a monomer unit means the reacted form of a monomer substance in a polymer.

Hereinafter, the present invention will be described in greater detail with reference to embodiments of the present invention, but the present invention is not limited thereto.

The magnetic toner of the present invention (hereinafter, also simply referred to as toner) is a magnetic toner including a magnetic toner particle that includes a binder resin, a magnetic body and a crystalline polyester, wherein a dielectric loss tangent of the magnetic toner at 100 kHz is 1.0×10' or more, in cross-sectional observation of the magnetic toner particle using a transmission electron microscope TEM, a variation coefficient CV3 of an occupied area ratio of the magnetic body when a cross section of the magnetic toner particle is divided by a square grid having a side of 0.8 μm is from 30.0% to 80.0%, and assuming that a storage elastic modulus at 40° C. is taken as E'(40) [Pa] and a storage elastic modulus at 85° C. is taken as E'(85) [Pa], the storage elastic moduli being obtained in a powder dynamic viscoelasticity measurement of the magnetic toner, the following formulas (1) and (2) are satisfied:

$$E'(85) \leq 5.5 \times 10^9 \quad (1)$$

$$[E'(40) - E'(85)] \times 100 / E'(40) \geq 30 \quad (2)$$

In the magnetic toner, the dispersion state of magnetic bodies in a magnetic toner particle (hereinafter, also simply referred to as toner particle) is controlled to control the dielectric loss tangent and storage elastic moduli of the magnetic toner.

The inventors of the present invention have found a method for solving the problems of improving the low-temperature fixability and suppressing the electrostatic offset by setting the dielectric loss tangent and storage elastic moduli of the magnetic toner within specific ranges.

However, regarding the durability, a problem was associated with the cracking of toner particle.

The inventors of the present invention thought that where a binder resin has a segment including no other substances, such as a domain, in a system in which a strong shear force is applied, such as a one-component contact development system, the domain will absorb the force applied to the magnetic toner and cracking will be prevented.

Thus, it is conceivable that the location where the binder resin is unevenly distributed in the magnetic toner particle, that is, the presence of a domain of the binder resin in the toner particle, is an effective solution for the problem of cracking and chipping of the toner particle.

The inventors of the present invention have found a means capable of forming a state in which magnetic bodies are aggregated to some extent in each toner particle. As a result, a toner which is resistant to cracking and excellent in low-temperature fixability and storage stability was obtained, and the present invention has been accomplished.

In the magnetic toner of the present invention, in cross-sectional observation of the magnetic toner particle using a transmission electron microscope (TEM), a variation coefficient CV3 of an occupied area ratio of the magnetic body when a cross section of the magnetic toner particle is divided by a square grid having a side of 0.8 μm is from 30.0% to 80.0%. The CV3 is preferably from 40.0% to 70.0%.

The fact that the CV3 is in the above range means that the magnetic bodies are unevenly localized in the magnetic toner particle. That is, by unevenly distributing the magnetic bodies in the magnetic toner particle, it is possible to appropriately provide a portion where the magnetic body is not present (that is, the domain portion of the binder resin), and to absorb the shear force applied from the outside in this portion. As a result, cracking of toner particle is suppressed, and in a system in which a strong shear force is applied, such as a one-component contact development system, fixing separability when a large number of images are outputted and satisfactory image which is free of electrostatic offset can be obtained. Further, by increasing resistance to cracking, it becomes possible to improve the storage elastic modulus and to increase the value of E'(40) [Pa].

When the CV3 is less than 30.0%, it means that the difference in the occupied area ratio of the magnetic body is small between the grids that divide the cross section of the magnetic toner particle, and the domains of the binder resin are not present, or the amount of resent domains of the binding resin is small.

In this case, most of the binder resin forms a fine network structure, and the connections between the binder resin portions become thin. As a result, in a system in which a strong shear force is applied, such as a one-component contact development system, the toner particle is easily cracked and electrostatic offset is generated due to charging failure.

Meanwhile, when the CV3 exceeds 80.0%, the magnetic bodies are excessively localized in the toner. In this case, the magnetic bodies aggregate to cause a decrease in tinting strength due to the reduction in surface area, and the image density in the initial period of image output decreases.

Controlling the hydrophilicity/hydrophobicity of the surface of the magnetic bodies, controlling the degree of aggregation of the magnetic bodies at the time of production of toner particles, and the like can be mentioned as methods for adjusting the CV3 in the above range.

For example, in the case of using an emulsion aggregation method, a method of aggregating the magnetic bodies in advance and introducing the aggregate into the toner particle, or a method of adding a chelating agent and/or adjusting the pH in the coalescence step to adjust the degree of aggregation of the magnetic bodies can be used.

Further, in cross-sectional observation of a magnetic toner particle using a transmission electron microscope (TEM), the average value of the occupied area ratio of the magnetic body when a cross section of the magnetic toner particle is divided by a square grid having a side of 0.8 μm is from 10.0% to 40.0%, and more preferably from 15.0% to 30.0%.

When the average value of the occupied area ratio of the magnetic body is in the above range, the dispersed state of the magnetic bodies in the toner particle becomes appropriate, and it is possible to suppress the decrease in tinting strength due to the excessive aggregation state.

Further, the amount of the present binder resin domains is appropriate, and the toner particle is less likely to be cracked. As a result, the electrostatic offset and the decrease in fixing separability hardly occur, and a satisfactory image can be obtained. In addition, controlling the hydrophilicity/hydrophobicity of the surface of the magnetic body, controlling the degree of aggregation of the magnetic bodies at the time of production of toner particles, and the like can be mentioned as methods for controlling the average value of the occupied area ratio of the magnetic body in the above range.

The dielectric loss tangent of the magnetic toner at 100 kHz is 1.0×10' or more. The dielectric loss tangent is preferably from 1.2×10' to 3.0×10'. The dielectric loss tangent indicates the ratio of dielectric constant to dielectric loss factor, and the larger the numerical value thereof, the higher the proportion of dielectric loss factor, indicating that charge relaxation after polarization is likely to occur.

When the dielectric loss tangent is in the above range, the charged state of the toner is appropriate even in a low-temperature environment, and the occurrence of charge-up resulting in excessive charging is prevented, thereby suppressing the electrostatic offset and making it possible to obtain a satisfactory image.

When the dielectric loss tangent is less than 1.0×10', charge relaxation is unlikely to occur, and it is easy to retain an excessive charge. As a result, when the toner is triboelectrically charged in a low-temperature environment, charge-up occurs causing electrostatic offset.

The dielectric loss tangent can be controlled by the dispersibility (aggregation) of the magnetic bodies in the toner particle. By dispersing the magnetic bodies in the toner particles without aggregation, dielectric polarization is likely to occur, and the value of the dielectric loss tangent can be reduced. Conversely, the value of the dielectric loss tangent can be increased by causing aggregation and making dielectric polarization less likely to occur. Further, the control can also be performed by the dispersion state of the magnetic bodies among the toner particles.

Here, the frequency to 100 kHz is set as a reference for measuring the dielectric loss tangent because such a frequency is suitable for verifying the dispersion state of the magnetic bodies. Where the frequency is lower than 100 kHz, the dielectric loss tangent becomes small, so it is difficult to understand the change in the dielectric loss tangent of the toner, and where the frequency is higher than 100 kHz, the difference in dielectric loss tangent when the temperature is changed becomes undesirably small.

Where the storage elastic modulus at 40° C. is taken as E'(40) [Pa] and the storage elastic modulus at 85° C. is taken as E'(85) [Pa], the storage elastic moduli being obtained in a powder dynamic viscoelasticity measurement of the magnetic toner, the following formulas (1) and (2) are satisfied:

$$E'(85) \leq 5.5\times10^{9} \quad (1)$$

$$[E'(40)-E'(85)]\times100/E'(40) \geq 30 \quad (2)$$

When E'(85) satisfies the above formula (1), the elasticity of the toner at the time of fixing becomes appropriate, and the adhesion to paper becomes strong, so that the low-temperature fixability is improved, durability of the image against rubbing is increased, electrostatic offset in a low-temperature environment can be suppressed, and a satisfactory image can be obtained.

When E'(85) exceeds $5.5\times10^9$, the elasticity is too high, and the adhesion to paper is lowered, so that the low-temperature fixability is lowered and the electrostatic offset tends to occur.

E'(85) can be controlled by the storage modulus of the binder resin and the addition amount of the crystalline polyester. The storage elastic modulus of the binder resin can be controlled by appropriately adjusting the types and molecular weights of constituent monomers.

Moreover, it is preferable that E'(85) satisfy a following formula (3).

$$E'(85)\leq5.0\times10^9 \quad (3)$$

The lower limit of E'(85) is not particularly limited, but is preferably $5.0\times10^8$ or more, and more preferably $1.0\times10^9$ or more.

The fact that E'(40) and E'(85) satisfy the equation (2) indicates that the magnetic toner can undergo a rapid elastic change at 40° C. to 85° C. As a result, in a system in which a strong shear force is applied, such as a one-component contact development system, it is possible to achieve both suppression of image quality deterioration, which is due to cracking and chipping of the toner particle, and low-temperature fixability.

When [E'(40)−E'(85)]×100/E'(40) is less than 30, elastic change does not occur at 40° C. to 85° C., and in a system in which a strong shear force is applied, such as a one-component contact development system, reduction in fixing separability due to cracking and chipping of the toner particle, or reduction in low-temperature fixability occurs.

[E'(40)−E'(85)]×100/E'(40) is preferably 40 or more. Meanwhile, the upper limit is not particularly limited, but is preferably 70 or less, more preferably 50 or less, and still more preferably 45 or less.

E'(40) and E'(85) can be controlled by the storage modulus of the binder resin and the addition amount of the crystalline polyester. The storage elastic modulus of the binder resin can be controlled by appropriately adjusting the types and molecular weights of constituent monomers.

It is preferable that the brightness and brightness dispersion value of the magnetic toner be controlled.

Generally, in the toner including magnetic bodies, it is preferable that the magnetic bodies be included more uniformly between toner particles. When toner particles having different content ratios of magnetic bodies are present, the charging performance and the magnetic performance will be different. In that case, especially in a system having magnetic conveyance or in a system in which development is performed by controlling the charging performance and magnetic performance of the toner, each toner particle may behave differently at the time of development, which can cause image failure such as decrease in density or the like.

Further, the brightness of the toner is an index indicating the degree of light scattering by the toner, and the brightness of the toner decreases when the toner includes a colorant or a substance, such as a magnetic body, that absorbs light.

Meanwhile, the brightness dispersion value of the toner is an index showing how much the brightness is uneven in one toner particle in the measurement of the brightness. Therefore, the variation coefficient of the brightness dispersion value serves as an index showing how much the brightness varies among the toner particles.

It was found that a satisfactory image without a decrease in density can be obtained by controlling the content ratio of the magnetic bodies among the magnetic toner particles and setting the brightness and the variation coefficient of brightness dispersion value of the magnetic toner to appropriate values.

Where a number average particle diameter of the magnetic toner is taken as Dn (μm), the average brightness at Dn of the magnetic toner is preferably from 30.0 to 60.0, and more preferably from 35.0 to 50.0.

When the average brightness is in the above range, the amount of the magnetic bodies is appropriate, satisfactory coloring property is demonstrated, cracking of the toner particle is easily prevented, and the fixing separability can be improved.

The average brightness can be adjusted to the above range by adjusting the amount of the magnetic bodies.

Further, where a variation coefficient of the brightness dispersion value of the magnetic toner in a range from Dn−0.500 to Dn+0.500 is taken as CV1(%), and a variation coefficient of the brightness dispersion value of the magnetic toner in a range from Dn−1.500 to Dn−0.500 is taken as CV2(%), the CV1 and the CV2 satisfy the following formula (4):

$$CV2/CV1\leq1.00 \quad (4)$$

The CV2/CV1 is more preferably from 0.70 to 0.95.

When CV2/CV1 is in the above range, the amount of the magnetic bodies in the magnetic toner particle hardly depends on the diameter of the toner particle. As a result, unevenness in charging of the toner particle and unevenness in magnetic characteristics are easily suppressed, and the developing performance tends to be satisfactory even when a large number of image outputs are performed.

Adjusting the particle diameter of the magnetic bodies can be mentioned as a means for controlling the CV2/CV1 in the above range. In addition, it is preferable to manufacture toner particles by using a pulverization method, an emulsion aggregation method, or the like, in which the magnetic bodies are easily taken into small-diameter particles.

CV1 is preferably 4.00% or less, and more preferably 3.50% or less.

When CV1 is in the above range, there is little difference in the state of presence of the magnetic bodies between the toner particles, the image density after continuous image formation is unlikely to change, and a satisfactory image can be obtained.

CV1 can be adjusted by controlling the dispersion state of the magnetic bodies at the time of manufacturing the toner particles.

The binder resin is not particularly limited, and a known resin for toner can be used. Specific examples of the binder resin include amorphous polyester resins, polyurethane resin, and vinyl resins.

Examples of the monomers that can be used for the production of vinyl resins are listed hereinbelow.

Aliphatic vinyl hydrocarbons: alkenes such as ethylene, propylene, butene, isobutylene, pentene, heptene, diisobutylene, octene, dodecene, octadecene, and other α-olefins; and alkadienes, such as butadiene, isoprene, 1,4-pentadiene, 1,6-hexadiene and 1,7-octadiene.

Alicyclic vinyl hydrocarbons: mono- or di-cycloalkenes and alkadienes, such as cyclohexene, cyclopentadiene, vinylcyclohexene, and ethylidenebicycloheptene; and terpenes such as pinene, limonene, and indene.

Aromatic vinyl hydrocarbons: styrene and hydrocarbyl (alkyl, cycloalkyl, aralkyl and/or alkenyl) substituents thereof, such as α-methylstyrene, vinyltoluene, 2,4-dimethylstyrene, ethyl styrene, isopropylstyrene, butyl styrene, phenylstyrene, cyclohexylstyrene, benzylstyrene, crotylbenzene, divinylbenzene, divinyltoluene, divinylxylene, trivinylbenzene; and vinylnaphthalene.

Carboxy group-containing vinyl-based monomers and metal salts thereof: unsaturated monocarboxylic acids having from 3 to 30 carbon atoms, unsaturated dicarboxylic acids, anhydrides thereof and monoalkyl (from 1 to 27 carbon atoms) esters thereof. For example, carboxy group-containing vinyl-based monomers such as acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoether itaconate, citraconic acid, citraconic acid monoalkyl esters and cinnamic acid.

Vinyl esters, such as vinyl acetate, vinyl butyrate, vinyl propionate, butyric acid vinyl ester, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxyacetate, vinyl benzoate, ethyl α-ethoxy acrylate, alkyl acrylates and alkyl methacrylates having an alkyl group (linear or branched) having from 1 to 22 carbon atoms (methyl acrylate, methyl methacrylate, ethyl acrylate, ethyl methacrylate, propyl acrylate, propyl methacrylate, butyl acrylate, butyl methacrylate, 2 ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, behenyl methacrylate, and the like), dialkyl fumarates (fumaric acid dialkyl ester, two alkyl groups are linear, branched or alicyclic groups having from 2 to 8 carbon atoms), dialkyl maleates (maleic acid dialkyl ester, two alkyl groups are linear, branched or alicyclic group having from 2 to 8 carbon atoms), polyaryloxyalkanes (diaryloxyethane, triaryloxyethane, tetraaryloxyethane, tetraaryloxypropane, tetraaryloxybutane, and tetramethallyloxyethane), vinyl-based monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is hereinafter abbreviated as EO) 10 mole adduct acrylate, methyl alcohol ethylene oxide 10 mole adduct methacrylate, lauryl alcohol EO 30 mole adduct acrylate, lauryl alcohol EO 30 mole adduct methacrylate), polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-containing vinyl esters: for example, carboxyalkyl acrylates having an alkyl chain having from 3 to 20 carbon atoms, and carboxyalkyl methacrylates having an alkyl chain having from 3 to 20 carbon atoms.

Among these, styrene, butyl acrylate, β-carboxyethyl acrylate and the like are preferable.

Examples of monomers that can be used for the manufacture of the amorphous polyester resin include conventionally well-known bivalent, trivalent or higher carboxylic acids and dihydric, trihydric or higher alcohols. Specific examples of these monomers are listed hereinbelow.

Examples of the divalent carboxylic acids include dibasic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid, dodecenyl succinic acid and the like, anhydrides thereof or lower alkyl esters thereof, and aliphatic unsaturated dicarboxylic acids such as maleic acid, fumaric acid, itaconic acid, citraconic acid and the like. Lower alkyl esters of these dicarboxylic acids and acid anhydrides can also be used.

Further, examples of trivalent or higher carboxylic acids include 1,2,4-benzenetricarboxylic acid, 1,2,5-benzenetricarboxylic acid, anhydrides thereof, lower alkyl esters thereof, and the like.

These may be used singly, or two or more thereof may be used in combination.

Examples of dihydric alcohols include alkylene glycols (1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-icosandiol); alkylene ether glycols (polyethylene glycol and polypropylene glycol); alicyclic diols (1,4-cyclohexanedimethanol); bisphenols (bisphenol A); alkylene oxide (ethylene oxide and propylene oxide) adducts of alicyclic diols, and alkylene oxide (ethylene oxide and propylene oxide) adducts of bisphenols (bisphenol A).

The alkyl moieties of the alkylene glycol and the alkylene ether glycol may be linear or branched. In the present invention, an alkylene glycol having a branched structure can also be preferably used.

In addition, aliphatic diols having a double bond can also be used. The following compounds can be mentioned as aliphatic diols having a double bond.

2-Butene-1,4-diol, 3-hexene-1,6-diol and 4-octene-1,8-diol.

Further, examples of the trihydric or higher alcohols include glycerin, trimethylolethane, trimethylolpropane and pentaerythritol.

These may be used singly, or two or more thereof may be used in combination.

For the purpose of adjusting the acid value and the hydroxyl value, a monobasic acid such as acetic acid and benzoic acid, and a monohydric alcohol such as cyclohexanol and benzyl alcohol can also be used, if necessary.

The binder resin preferably includes an amorphous polyester.

Among these, from the viewpoint of paper adhesion, the weight average molecular weight of the amorphous polyester is preferably 90,000 or less.

Further, from the viewpoint of the difference in image density before and after repeated use, the weight average molecular weight is preferably 1500 or more.

A method for synthesizing the amorphous polyester resin is not particularly limited, and for example, a transesterification method or a direct polycondensation method can be used singly or in combination.

Next, the polyurethane resin is described.

The polyurethane resin is a reaction product of a diol and a compound including a diisocyanate group. By combining various diols and compounds including a diisocyanate group, polyurethane resins having various functionalities can be obtained.

The compounds containing a diisocyanate group can be exemplified by aromatic diisocyanates having from 6 to 20 carbon atoms (excluding carbon in an NCO group, the same applies hereinafter), aliphatic diisocyanates having from 2 to 18 carbon atoms, alicyclic diisocyanates having from 4 to 15 carbon atoms and modified products of these diisocyanates (modified products including an urethane group, a carbodiimide group, an allophanate group, an urea group, a biuret group, an uretdione group, an uretimine group, an isocyanurate group or an oxazolidone group; can be also referred to hereinbelow as "modified diisocyanates"), and mixtures of two or more thereof.

Examples of the aromatic diisocyanates include m- and/or p-xylylene diisocyanate (XDI) and α,α,α', α'-tetramethyl xylylene diisocyanate and the like.

Examples of the aliphatic diisocyanates include ethylene diisocyanate, tetramethylene diisocyanate, hexamethylene diisocyanate (HDI), dodecamethylene diisocyanate and the like.

Further, examples of the alicyclic diisocyanates include isophorone diisocyanate (IPDI), dicyclohexylmethane-4,4'-diisocyanate, cyclohexylene diisocyanate, methylcyclohexylene diisocyanate and the like.

Among these, aromatic diisocyanates having from 6 to 15 carbon atoms, aliphatic diisocyanates having from 4 to 12 carbon atoms, and alicyclic diisocyanates having from 4 to 15 carbon atoms are preferable, and XDI, IPDI and HDI are more preferable. In addition to the above diisocyanates, trifunctional or higher functional isocyanate compounds can also be used.

A diol that can be used for a polyurethane resin can be exemplified by the same dihydric alcohols that can be used for the non-crystalline polyester mentioned above.

A resin such as an amorphous polyester resin, a polyurethane resin, and a vinyl resin may be used singly or in combination of two or more thereof as the binder resin. From the viewpoint of using crystalline polyester, the binder resin preferably includes an amorphous polyester resin, and is preferably an amorphous polyester resin. When using two or more types thereof together, the resins may be used in the form of a composite resin in which the resins are chemically bonded together.

From the viewpoint of low-temperature fixability, the glass transition temperature (Tg) of the binder resin is preferably from 40.0° C. to 120.0° C.

The toner particle includes crystalline polyester. The crystalline polyester is preferably a condensation polymerization product of a monomer including an aliphatic diol and/or an aliphatic dicarboxylic acid. The crystalline resin, as referred to herein, means a resin which shows a clear melting point by the measurement using a differential scanning calorimeter (DSC).

The crystalline polyester resin preferably includes a monomer unit derived from an aliphatic diol having 2 to 12 carbon atoms, and/or a monomer unit derived from an aliphatic dicarboxylic acid having 2 to 12 carbon atoms.

Examples of the aliphatic diol having from 2 to 12 carbon atoms include the following compounds.

1,2-Ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

In addition, an aliphatic diol having a double bond can also be used. The aliphatic diol having a double bond can be exemplified by the following compounds.

2-Butene-1,4-diol, 3-hexene-1,6-diol and 4-octene-1,8-diol.

The aliphatic dicarboxylic acid having from 2 to 12 carbon atoms can be exemplified by the following compounds.

Oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid. Lower alkyl esters and acid anhydrides of these aliphatic dicarboxylic acids can also be used.

Among these, sebacic acid, adipic acid and 1,10-decanedicarboxylic acid and lower alkyl esters and acid anhydrides thereof are preferred. These may be used singly or in combination of two or more thereof.

In addition, an aromatic carboxylic acid can also be used. The aromatic dicarboxylic acid can be exemplified by the following compounds. Terephthalic acid, isophthalic acid, 2,6-naphthalenedicarboxylic acid and 4,4'-biphenyldicarboxylic acid. Among these, terephthalic acid is preferable from the standpoint of easy availability and easy formation of a polymer having a low melting point.

Also, a dicarboxylic acid having a double bond can be used. The dicarboxylic acid having a double bond can be suitably used in order to suppress the hot offset at the time of fixing because such an acid makes it possible to crosslink the entire resin by using the double bond.

Such a dicarboxylic acid can be exemplified by fumaric acid, maleic acid, 3-hexenediodic acid and 3-octendenic acid. Also included are lower alkyl esters and acid anhydrides thereof. Among these, fumaric acid and maleic acid are more preferable.

A method for manufacturing a crystalline polyester is not particularly limited, and can be implemented by the general polymerization method of polyesters in which a dicarboxylic acid component and a diol component are reacted with each other. For example, direct polycondensation or transesterification can be used depending on the type of monomers.

The peak temperature of the maximum endothermic peak of the crystalline polyester measured using a differential scanning calorimeter (DSC) is preferably from 50.0° C. to 100.0° C., and more preferably, from the viewpoint of low-temperature fixability, from 60.0° C. to 90.0° C.

The amount of the crystalline polyester in the magnetic toner is preferably 15.0% by mass or less. More preferably, this amount is from 1.0% by mass to 10.0% by mass. When the amount is 15.0% by mass or less, it is possible to improve the low-temperature fixability without affecting the dielectric loss tangent of the toner or the cracking or chipping of the toner particle.

In addition, since the occupied area ratio of the magnetic bodies is unlikely to decrease, excessive aggregation of the magnetic bodies can be suppressed, and a decrease in image density can be suppressed. Further, since the relative amount of binder resin is appropriate, the connections between the portions of binder resin in the toner become satisfactory. As a result, in a system in which a high shear force is applied to a toner, such as a one-component contact development system, a toner particle is less likely to be cracked, and electrostatic offset due to charging failure and deterioration of fixing separability due to fixing device contamination can be suppressed.

In the cross section of a magnetic toner particle observed with a transmission electron microscope, it is preferable that domains of the crystalline polyester be present inside the magnetic toner particle. The number average diameter of the domains is preferably from 50 nm to 500 nm, and more preferably from 100 nm to 400 nm.

The number average diameter of the domains can be measured in cross-sectional observation of a magnetic toner particle using a transmission electron microscope (TEM). Thirty domains of the crystalline polyester having a major axis of 20 nm or more are randomly selected, the average value of the major and minor axes is taken as the domain diameter, and the arithmetic average value for 30 domains is taken as the number average diameter of the domains. The selection of domains may not be in the same toner particle.

When the number average diameter of the domains is in the above range, excessive aggregation of the magnetic bodies is suppressed, and the binder resin is efficiently plasticized thereby improving the low-temperature fixability.

The number average diameter of the domains can be adjusted by the addition amount of the crystalline polyester, or when the emulsion aggregation method is used to produce the toner, by the diameter of the crystalline polyester particles in the crystalline polyester-dispersed solution, the retention time in the coalescence step, the cooling rate after the coalescence, and the like.

The magnetic toner particle may include a wax.

A well-known wax may be used. Specific examples of the wax are presented hereinbelow.

Petroleum waxes such as paraffin wax, microcrystalline wax, petrolactam and the like and derivatives thereof, montan wax and derivatives thereof, hydrocarbon waxes obtained by a Fischer-Tropsch method and derivatives thereof, polyolefin waxes represented by polyethylene and polypropylene, and derivatives thereof, natural waxes such as carnauba wax, candelilla wax and derivatives thereof, ester waxes and the like.

Here, the derivatives include oxides, block copolymers with vinyl-based monomers, and graft modified products.

In addition, a monoester compound including one ester bond in a molecule and a polyfunctional ester compound such as a diester compound including two ester bonds in a molecule, a tetrafunctional ester compound including four ester bonds in a molecule, a hexafunctional ester compound including six ester bonds in a molecule and the like can be used as the ester wax.

The ester wax preferably includes at least one compound selected from the group consisting of monoester compounds and diester compounds.

Specific examples of the monoester compounds include waxes mainly composed of a fatty acid ester, such as carnauba wax, montanic acid ester wax and the like; compounds obtained by partial or complete removal of the acid component from a fatty acid ester, such as a deacidified carnauba wax and the like, compounds obtained by hydrogenation of vegetable oils and fats, and the like, and methyl ester compounds having a hydroxy group; and saturated fatty acid monoesters such as stearyl stearate and behenyl behenate.

Further, specific examples of the diester compound include dibehenyl sebacate, nonanediol dibehenate, dibehenyl terephthalate, distearyl terephthalate and the like.

In addition, the wax can include well-known other waxes other than the abovementioned compounds. Further, one type of wax may be used singly, or two or more types may be used in combination.

The amount of the wax is preferably from 1.0 part by mass to 30.0 parts by mass, and more preferably from 3.0 parts by mass to 25.0 parts by mass with respect to 100 parts by mass of the binder resin.

Examples of the magnetic body include iron oxides such as magnetite, maghemite, ferrite and the like; metals such as iron, cobalt, nickel and the like, alloys of these metals with a metal such as aluminum, copper, magnesium, tin, zinc, beryllium, calcium, manganese, selenium, titanium, tungsten, vanadium and the like, and mixtures thereof.

The number average particle diameter of the primary particles of the magnetic bodies is preferably 0.50 μm or less, and more preferably from 0.05 μm to 0.30 μm.

The number average particle diameter of the primary particles of the magnetic bodies present in the toner particle can be measured using a transmission electron microscope.

Specifically, after sufficiently dispersing toner particles to be observed in an epoxy resin, curing is performed in an atmosphere having a temperature of 40° C. for 2 days to obtain a cured product. The resulting cured product is sliced into a flaky sample by a microtome, an image at a magnification of 10,000 to 40,000 is captured in a transmission electron microscope (TEM), and the projected area of 100 primary particles of the magnetic bodies in the image is measured. Then, the equivalent diameter of the circle equal to the projected area is taken as the particle diameter of the primary particle of the magnetic body, and the average value of 100 particle diameters is taken as the number average particle diameter of the primary particles of the magnetic bodies.

As a magnetic property of the magnetic body at 795.8 kA/m application, a coercive force (Hc) is preferably 1.6 kA/m to 12.0 kA/m. The magnetization strength ($\sigma s$) is preferably 50 $Am^2/kg$ to 200 $Am^2/kg$, and more preferably 50 $Am^2/kg$ to 100 $Am^2/kg$. Meanwhile, the residual magnetization ($\sigma r$) is preferably 2 $Am^2/kg$ to 20 $Am^2/kg$. The amount of the magnetic bodies in the magnetic toner is preferably from 35% by mass to 50% by mass, and more preferably from 40% by mass to 50% by mass.

When the amount of the magnetic bodies is within the above range, the magnetic attraction with the magnet roll in the developing sleeve is appropriate.

The amount of the magnetic bodies in the magnetic toner can be measured using a thermal analyzer TGA Q5000IR manufactured by Perkin Elmer Co. The measurement method is as follows: the magnetic toner is heated from normal temperature to 900° C. at a temperature rise rate of 25° C./min in a nitrogen atmosphere, the mass lost at 100° C. to 750° C. is taken as the mass of the components other than the magnetic bodies in the magnetic toner, and the residual mass is taken as the mass of magnetic bodies.

The magnetic bodies can be produced, for example, by the following method.

An alkali such as sodium hydroxide or the like in an amount equivalent to the iron component or in a large amount is added to an aqueous ferrous salt solution to prepare an aqueous solution including ferrous hydroxide. Air is blown while maintaining the pH of the prepared aqueous solution at 7 or more, oxidation reaction of ferrous hydroxide is performed while heating the aqueous solution to 70° C. or more, and seed crystals to be the magnetic iron oxide cores are first generated.

Next, an aqueous solution including about 1 equivalent of ferrous sulfate based on the amount of alkali, which has been added previously, is added to the slurry including the seed crystals. The pH of the mixed solution is maintained at 5 to 10, the reaction of ferrous hydroxide is advanced while blowing the air, and magnetic iron oxide is grown on the seed crystals as the cores. At this time, it is possible to control the shape and magnetic properties of the magnetic bodies by selecting any pH, reaction temperature and stirring conditions. As the oxidation reaction proceeds, the pH of the mixture shifts to the acidic side, but the pH of the mixture should not be less than 5. Magnetic bodies can be obtained by filtering, washing and drying the magnetic bodies, which have been thus obtained, according to a conventional method.

In addition, the magnetic bodies may be subjected to known surface treatment as needed.

The magnetic toner particle may include a charge control agent. The magnetic toner is preferably a negative-charging toner.

Organometallic complex compounds and chelate compounds are effective as charge control agents for negative charge, and examples thereof include monoazo metal complex compounds; acetylacetone metal complex compounds; metal complex compounds of aromatic hydroxycarboxylic acid or aromatic dicarboxylic acid, and the like.

Specific examples of commercially available products include SPILON BLACK TRH, T-77, T-95 (Hodogaya Chemical Industry Co., Ltd.), and BONTRON (registered trademark) S-34, S-44, S-54, E-84, E-88, and E-89 (Orient Chemical Industry Co., Ltd.).

The charge control agents can be used singly or in combination of two or more thereof.

From the viewpoint of charge quantity, the amount of the charge control agent is preferably from 0.1 parts by mass to 10.0 parts by mass, and more preferably from 0.1 parts by mass to 5.0 parts by mass with respect to 100 parts by mass of the binder resin.

The glass transition temperature (Tg) of the magnetic toner is preferably from 45.0° C. to 70.0° C., and more preferably from 50.0° C. to 65.0° C.

When the glass transition temperature is in the above range, both storage stability and low-temperature fixability can be achieved at a high level. The glass transition temperature can be controlled by the composition of the binder resin, the type of the crystalline polyester, the molecular weight of the binder resin, and the like.

A method for producing the magnetic toner is not particularly limited, and any of dry production methods (for example, kneading and pulverizing method and the like) and wet production methods (for example, emulsion aggregation method, suspension polymerization method, dissolution and suspension method and the like) may be used.

Among these, it is preferable to use the emulsion aggregation method.

When the emulsion aggregation method is used, the variation coefficient of the brightness dispersion value of the magnetic toner, the variation coefficient of the occupied area ratio of the magnetic bodies, and the number average diameter of domains of the crystalline polyester, and the like can be easily adjusted to the above-mentioned ranges.

The method for producing toner particles by using the emulsion aggregation method will be described hereinbelow by way of a specific example.

The emulsion aggregation method is roughly divided into the following four steps:

(a) a step of preparing a fine particle-dispersed solution, (b) an aggregation step of forming aggregated particles, (c) a coalescence step of forming toner particles by melting and coalescence, (d) a washing and drying step.

(a) Step of Preparing Fine Particle-Dispersed Solution

A particle-dispersed solution is obtained by dispersing fine particles of each material such as a binder resin, a magnetic body and a crystalline polyester in an aqueous medium.

Examples of the aqueous medium include water such as distilled water, ion exchange water, and the like and alcohols. These may be used singly or in combination of two or more thereof.

An auxiliary agent for dispersing the fine particles in the aqueous medium may be used, surfactants being examples of the auxiliary agent.

Surfactants include anionic surfactants, cationic surfactants, amphoteric surfactants, and nonionic surfactants.

Specific examples include anionic surfactants such as alkylbenzene sulfonates, α-olefin sulfonates, and phosphoric acid esters; cationic surfactants of amine salt type such as alkylamine salts, amino alcohol fatty acid derivatives, polyamine fatty acid derivatives, and imidazoline, or quaternary ammonium salt type such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohols derivatives; and amphoteric surfactants such as alanine, dodecyldi(aminoethyl) glycine, di(octylaminoethyl) glycine and N-alkyl-N,N-dimethylammonium betaines.

The surfactants may be used singly or in combination of two or more thereof.

A method for preparing the fine particle-dispersed solution can be appropriately selected according to the type of dispersoid.

For example, a method for dispersing the dispersoid by using a general dispersing machine such as a rotary shear type homogenizer, a ball mill a sand mill, a dyno mill or the like having a medium can be mentioned. Moreover, in the case of a dispersoid which dissolves in an organic solvent, the dispersoid may be dispersed in an aqueous medium by using the phase inversion emulsification method. In the phase inversion emulsification method, the material to be dispersed is dissolved in an organic solvent in which the material is soluble, the organic continuous phase (O phase) is neutralized, and then a water medium (W phase) is introduced to perform conversion of resin (so-called phase inversion) from W/O to O/W, induce discontinuous phase formation and disperse in the form of particles in an aqueous medium.

The solvent used in the phase inversion emulsification method is not particularly limited as long as the solvent dissolves the resin, but it is preferable to use a hydrophobic or amphiphilic organic solvent for the purpose of forming droplets.

It is also possible to prepare a fine particle-dispersed solution by carrying out polymerization after forming droplets in an aqueous medium as in emulsion polymerization. Emulsion polymerization is a method for obtaining a fine particle-dispersed solution in which a material is dispersed in an aqueous medium by first mixing a precursor of the material to be dispersed, the aqueous medium, and a polymerization initiator and then stirring or shearing. At this time, an organic solvent or a surfactant may be used as an aid for emulsification. Further, a common apparatus may be used for stirring or shearing, and an example thereof is a common disperser, such as a rotation shear type homogenizer.

When dispersing magnetic bodies, particles with a target diameter of primary particles may be dispersed in an aqueous medium. For the dispersion, for example, a general disperser such as a rotary shear type homogenizer, a ball mill, a sand mill, a dyno mill or the like having media may be used. Since magnetic bodies have a specific gravity higher than that of water and have a high sedimentation rate, it is preferable to immediately proceed to the aggregation step after dispersion.

From the viewpoint of control of aggregation speed and simplicity of coalescence, the number average particle diameter of the dispersoid of the fine particle-dispersed solution is preferably, for example, from 0.01 μm to 1 μm, more preferably from 0.08 μm to 0.8 μm, and even more preferably from 0.1 μm to 0.6 μm.

From the viewpoint of controlling the aggregation speed, the dispersoid in the fine particle-dispersed solution is preferably from 5% by mass to 50% by mass, and more preferably from 10% by mass to 40% by mass based on the total amount of the dispersion.

(b) Aggregation Step

After preparing the fine particle-dispersed solution, one kind of fine particle-dispersed solution or two or more kinds of particle-dispersed solutions are mixed to prepare an agglomerated particle-dispersed solution in which agglomerated particles in which the fine particles are agglomerated are dispersed.

The mixing method is not particularly limited, and the mixing can be performed using a common stirrer.

The aggregation is controlled by the temperature, pH, flocculant and the like of the aggregated particle-dispersed solution, and any method may be used.

The temperature at which the aggregated particles are formed is preferably from a glass transition temperature of the binder resin minus 30.0° C. to a glass transition temperature of the binder resin. From an industrial viewpoint, the time is preferably about 1 min to 120 min.

The flocculant can be exemplified by inorganic metal salts, metal complexes with a valence of two or more, and the like. When a surfactant is used as an auxiliary agent in the fine particle-dispersed solution, it is also effective to use a surfactant of reverse polarity. In particular, when a metal complex is used as the flocculant, the amount of surfactant used is reduced, and the charging characteristics are improved. Examples of inorganic metal salts include metal salts such as sodium chloride, calcium chloride, calcium nitrate, barium chloride, magnesium chloride, magnesium sulfate, zinc chloride, aluminum chloride, aluminum sulfate and the like, and inorganic metal salt polymers such as polyaluminum chloride, polyaluminum hydroxide, calcium polysulfide and the like.

The timing of mixing of the fine particle-dispersed solution is not particularly limited, and the fine particle-dispersed solution may be further added for aggregation after the aggregated particle-dispersed solution has been formed or in the course of formation.

By controlling the addition timing of the fine particle-dispersed solution, it is possible to control the internal structure of the toner particle.

In order to control the degree of aggregation of the above-mentioned magnetic bodies, for example, a pre-aggregation step of adding the flocculant to the magnetic body-dispersed solution and stirring can be performed before aggregating each fine particle-dispersed solution. In the pre-aggregation step, for example, it is preferable to add about 0.3 to 2.0 parts by mass of the flocculant to 100 parts by mass of the magnetic bodies at about 20° C. to 60° C. and stir for about 5 sec to 5 min.

Alternatively, a method is also preferable in which the magnetic body-dispersed solution is added and the aggregation is further performed after the fine particle-dispersed solution other than the magnetic body-dispersed solution is aggregated.

Further, in the aggregation step, a stirring device capable of controlling the stirring speed may be used. The stirring device is not particularly limited, and any general-purpose emulsifying machine and dispersing machine can be used.

For example, a batch-type emulsification machine such as ULTRA TURRAX (manufactured by IKA Corporation), POLYTRON (manufactured by Kinematica Co.), T. K. HOMOMIXER (manufactured by Tokushu Kika Kogyo Co., Ltd.), EBARA MILDER (manufactured by Ebara Corp.), T. K. HOMOMIC LINE FLOW (manufactured by Tokushu Kika Kogyo Co., Ltd.), CREAMIX (manufactured by M Technique Co., Ltd.), PHILMIX (manufactured by Tokushu Kika Kogyo Co., Ltd.), or both batch-type and continuous-type emulsification machine can be used.

The stirring speed may be appropriately adjusted according to the production scale.

In particular, magnetic bodies having a heavy specific gravity are susceptible to the stirring speed. By adjusting the stirring speed and the stirring time, it is possible to control to the desired particle size. When the stirring speed is high, aggregation is likely to be promoted, aggregation of the magnetic bodies proceeds, and a toner with a low brightness is likely to be finally formed.

Further, when the stirring speed is low, the magnetic bodies tend to settle, the aggregated particle dispersion liquid becomes nonuniform, and a difference is easily caused in the introduction amount of the magnetic bodies between the particles.

Meanwhile, it is also possible to control the aggregation state by adding a surfactant.

It is preferable to terminate the aggregation when the aggregated particles reach the target particle size.

The termination of aggregation can be performed by dilution, temperature control, pH control, addition of a chelating agent, addition of a surfactant, and the like, and the addition of a chelating agent is preferable from the viewpoint of production. Furthermore, it is a more preferable method to terminate the aggregation by addition of a chelating agent and adjustment of pH. When the addition of the chelating agent and the adjustment of the pH are used in combination, it is possible to form a toner particle in which the magnetic bodies are slightly aggregated after the subsequent coalescence step.

The pH can be adjusted by known methods using an aqueous solution of sodium hydroxide or the like. It is preferable to adjust the pH to 7.0 to 11.0, and more preferably to 7.5 to 10.0.

As the chelating agent, a water-soluble chelating agent is preferred. Specific examples of the chelating agent include, for example, hydroxycarboxylic acids such as tartaric acid, citric acid, gluconic acid and the like, iminodiacid (IDA), nitrilotriacetic acid (NTA), ethylenediaminetetraacetic acid (EDTA) and the like.

The addition amount of the chelating agent is, for example, preferably from 10.0 parts by mass to 100.0 parts by mass, and more preferably from 20.0 parts by mass to 70.0 parts by mass with respect to 100 parts by mass of the magnetic bodies.

(c) Coalescence Step

After forming the aggregated particles, the particles are heated to form toner particles by melting and coalescence. The heating temperature is preferably equal to or higher than the glass transition temperature of the binder resin. For example, 45° C. to 130° C.

Industrially, the time is preferably 1 min to 900 min, and more preferably 5 min to 500 min.

Further, a toner particle having a core/shell structure may be also formed by heating and coalescing the aggregated particles, then mixing the solution in which particles such as resin are dispersed, and further performing the step (b) of forming the aggregated particles and the step (c) of melting and coalescing.

After coalescence, the toner particles can be cooled by known methods. The cooling rate is preferably about 0.1° C./min to 500° C./min.

(d) Washing and Drying Step

Well-known washing method, solid-liquid separation method, and drying method may be used without particular limitation.

However, in the washing step, it is preferable to carry out substitution washing with ion exchange water sufficiently from the viewpoint of charging performance. In the solid-liquid separation step, suction filtration, pressure filtration and the like are preferably performed from the viewpoint of productivity. In the drying step, it is preferable to perform freeze drying, flash jet drying, fluid drying, vibration type fluid drying and the like from the viewpoint of productivity.

The magnetic toner particles may be mixed, if necessary, with an external additive to make the magnetic toner in order to improve the flowability and/or the charging performance of the toner. A known device, for example, a Henschel mixer may be used for mixing of the external additive.

As the external additive, inorganic fine particles having a number average particle diameter of primary particles of from 4 nm to 80 nm are preferable, and inorganic fine particles having a number average particle diameter of primary particles of from 6 nm to 40 nm are more preferable.

The inorganic fine particles can further improve the charging performance and environmental stability of the toner when subjected to a hydrophobization treatment. Examples of treatment agents to be used for the hydrophobization treatment include silicone varnish, various modified silicone varnishes, silicone oils, various modified silicone oils, silane compounds, silane coupling agents, other organic boron compounds, organic titanium compounds and the like. The treatment agents may be used singly or in combination of two or more thereof.

The number average particle diameter of the primary particles of the inorganic fine particles may be calculated using an image of the toner captured by a scanning electron microscope (SEM).

Examples of the inorganic fine particles include silica fine particles, titanium oxide fine particles, alumina fine particles and the like. As the silica fine particles, for example, both dry silica such as silica or fumed silica produced by so-called dry method and generated by vapor phase oxidation of a silicon halide, and so-called wet silica produced from water glass and the like can be used.

However, dry silica having fewer silanol groups on the surface and inside the silica fine particles and having less production residues such as $Na_2O$ and $SO_3^{-2}$ is preferable.

In the production step of dry silica, it is also possible to obtain composite fine particles of silica and other metal oxides, for example, by using other metal halides such as aluminum chloride, titanium chloride and the like together with the silicon halide in the production process, and the concept of dry silica is inclusive of such particles.

The amount of the inorganic fine particles is preferably from 0.1 parts by mass to 3.0 parts by mass with respect to 100 parts by mass of the toner particles. The amount of the inorganic fine particles may be quantitatively determined from a calibration curve prepared from a standard sample using a fluorescent X-ray analyzer.

The magnetic toner may include other additives as long as the effects of the present invention are not adversely affected.

Examples of other additives include lubricant powder such as fluorocarbon resin powder, zinc stearate powder, polyvinylidene fluoride powder and the like; abrasives such as cerium oxide powder, boron carbide powder, strontium titanate powder and the like; anti-caking agents and the like. Other additives can also be used after the surface thereof is hydrophobized.

The volume average particle diameter (Dv) of the magnetic toner is preferably from 3.0 μm to 8.0 μm, and more preferably from 5.0 μm to 7.0 μm.

By setting the volume average particle diameter (Dv) of the toner within the above range, it is possible to sufficiently satisfy the dot reproducibility while improving toner handleability.

Further, the ratio (Dv/Dn) of the volume average particle diameter (Dv) to the number average particle diameter (Dn) of the magnetic toner is preferably less than 1.25.

The average circularity of the magnetic toner is preferably from 0.960 to 1.000, and more preferably from 0.970 to 0.990.

When the average circularity is in the above range, even in a system with a strong shear force, such as a one-component contact development system, the toner is unlikely to be compacted and the flowability of the toner is easily maintained. As a result, when performing a large number of image outputs, it is possible to further suppress the decrease in fixing separability.

The average degree of circularity may be controlled by a method generally used at the time of toner production. For example, in the emulsion aggregation method, it is preferable to control the duration of the coalescence step and the amount of surfactant added.

In the one-component contact development system, a toner bearing member and an electrostatic latent image bearing member are arranged in contact (contact arrangement) with each other, and these bearing members carry the toner by rotating.

A strong shear force occurs in the contact portion between the toner bearing member and the electrostatic latent image bearing member. Therefore, in order to obtain a high quality image, it is preferable that the toner have high durability and high flowability.

Meanwhile, as the development system, the one-component development system makes it possible to miniaturize the cartridge in which the developer is stored, as compared with the two-component development system using a carrier.

In addition, the contact development system makes it possible to obtain high quality images with little toner scattering. That is, the one-component contact development system demonstrating the abovementioned effects in combination makes it possible to achieve both downsizing of the developing device and high image quality.

Hereinafter, the one-component contact development system will be described in detail with reference to the drawings.

Figure 2:
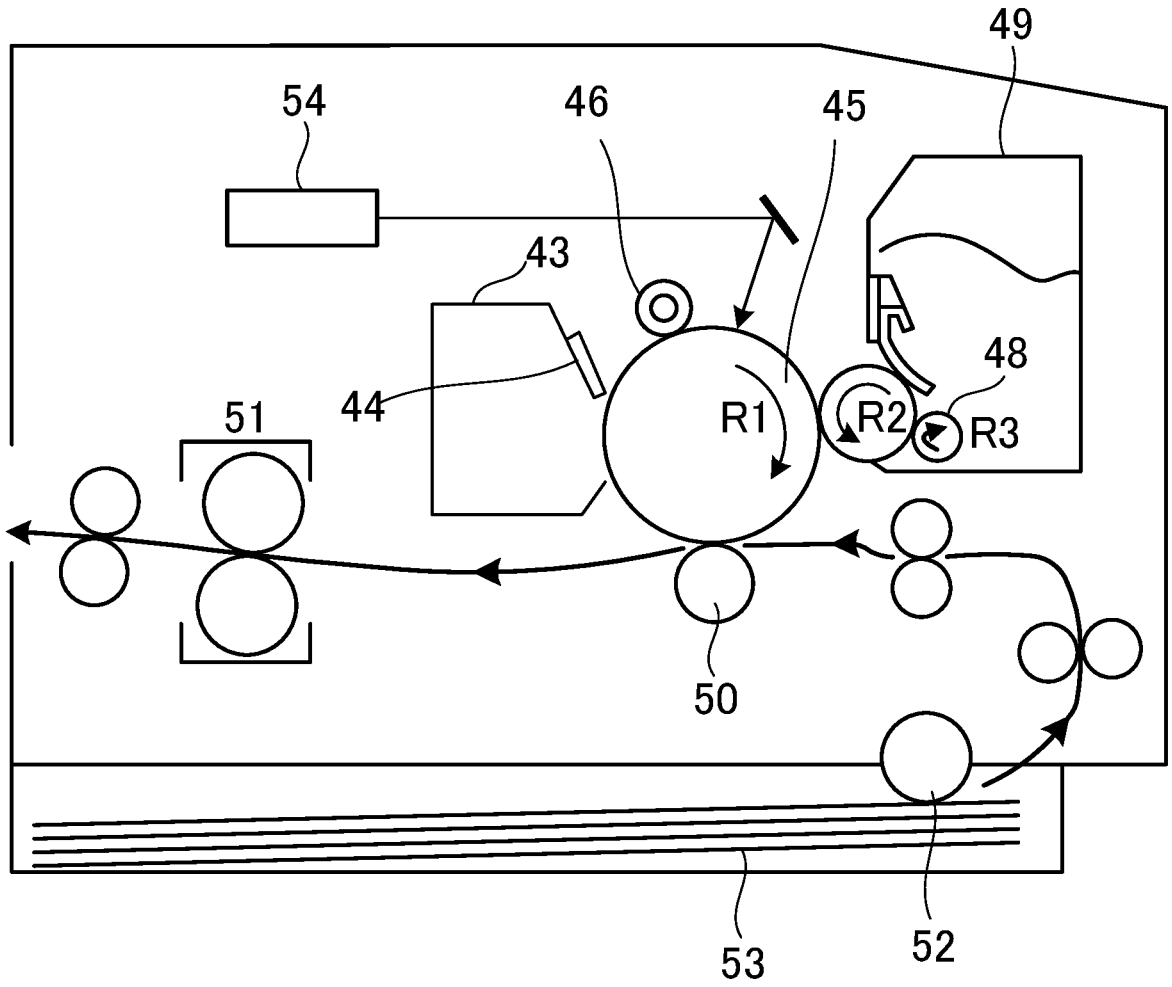
FIG. 2 is a schematic cross-sectional view of an image forming apparatus of a one-component contact development system.

FIG. 1 is a schematic cross-sectional view showing an example of a developing device. FIG. 2 is a schematic cross-sectional view showing an example of a one-component contact development type image forming apparatus.

In FIGS. 1 and 2, an electrostatic latent image bearing member 45 on which an electrostatic latent image is formed is rotated in the direction of an arrow R1. The toner bearing member 47 rotates in the direction of an arrow R2 to transport a toner 57 to a development area where the toner bearing member 47 and the electrostatic latent image bearing member 45 are opposed to each other. Further, a toner supply member 48 is in contact with the toner bearing member 47, and the toner 57 is supplied to the surface of the toner bearing member 47 by rotating the toner supply member in the direction of an arrow R3. Further, the toner 57 is stirred by a stirring member 58.

A charging member (charging roller) 46, a transfer member (transfer roller) 50, a cleaner container 43, a cleaning blade 44, a fixing device 51, a pickup roller 52 and the like are provided around the electrostatic latent image bearing member 45. The electrostatic latent image bearing member 45 is charged by the charging roller 46.

Then, the electrostatic latent image bearing member 45 is irradiated with laser light by a laser generator 54 to perform exposure, thereby forming an electrostatic latent image corresponding to the target image.

The electrostatic latent image on the electrostatic latent image bearing member 45 is developed by the toner 57 in the developing device 49 to obtain a toner image. The toner image is transferred onto a transfer material (paper) 53 by the transfer member (transfer roller) 50 which is in contact with the electrostatic latent image bearing member 45, with the transfer material being interposed therebetween. Transfer of the toner image to the transfer material may be performed via an intermediate transfer member. The transfer material (paper) 53 bearing the toner image is conveyed to the fixing device 51 and the toner image is fixed on the transfer material (paper) 53. Further, the toner 57 left partially on the electrostatic latent image bearing member 45 is scraped off by the cleaning blade 44 and stored in the cleaner container 43.

In addition, it is preferable that the toner layer thickness on the toner bearing member be regulated by the toner regulating member (reference numeral 55 in FIG. 1) being in contact with the toner bearing member with the toner being interposed therebetween. By doing this, it is possible to obtain high image quality without regulatory failure. A regulating blade is generally used as a toner regulating member that is in contact with the toner bearing member.

The base which is the upper side of the regulating blade is fixedly held on the developing device side, and the lower side may be bent in the forward or reverse direction of the toner bearing member against the elastic force of the blade to be brought into contact with the toner bearing member surface with a suitable elastic pressing force.

For example, as shown in FIG. 1, the toner regulating member 55 may be fixedly attached to the developing device by sandwiching and fastening a free end on one side of the toner regulating member 55 between two fixing members (for example, metal elastic bodies, reference numeral 56 in FIG. 1).

Methods for measuring various physical property values according to the present invention are described hereinbelow. Method for Measuring Volume Average Particle Diameter (Dv) and Number Average Particle Diameter (Dn) of Magnetic Toner The volume average particle diameter (Dv) and number average particle diameter (Dn) of the magnetic toner are calculated in the following manner.

A precision particle diameter distribution measuring apparatus "Coulter Counter Multisizer 3" (registered trademark, manufactured by Beckman Coulter, Inc.) equipped with a 100-μm aperture tube and based on a pore electric resistance method is used as a measuring device. The dedicated software "Beckman Coulter Multisizer 3 Version 3.51" (manufactured by Beckman Coulter, Inc.) provided with the device is used for setting measurement conditions and performing measurement data analysis. The measurement is performed with 25,000 effective measurement channels.

A solution prepared by dissolving special grade sodium chloride in ion exchange water to a concentration of about 1% by mass, for example, "ISOTON II" (manufactured by Beckman Coulter, Inc.), can be used as the electrolytic aqueous solution.

The dedicated software is set up in the following manner before the measurement and analysis.

The total count number in a control mode is set to 50,000 particles on a "CHANGE STANDARD MEASUREMENT METHOD (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "MEASUREMENT BUTTON OF THE THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rev/sec. Dirt and air bubbles in the aperture tube are removed by the "FLUSH OF APERTURE TUBE" function of the dedicated software.

(2) Approximately 30 ml of the electrolytic aqueous solution is placed in a glass 100 mL flat-bottom beaker. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchange water is added.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchange water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the magnetic toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the volume average particle diameter (Dv) and number average particle diameter (Dn) are calculated. The "50% D diameter" on the "ANALYSIS/VOLUME STATISTICAL VALUE (ARITHMETIC MEAN)" screen obtained when the graph/(% by volume) is set in the dedicated software is taken as the volume average particle diameter (Dv), and the "ARITHMETIC DIAMETER" on the "ANALYSIS/NUMBER STATISTICAL VALUE (ARITHMETIC MEAN)" screen obtained when the graph/(% by number) is set in the dedicated software is taken as the number average particle diameter (Dn).

Method for Measuring Average Brightness, Brightness Dispersion Value, Variation Coefficient Thereof, and Average Circularity of Magnetic Toner The average brightness, brightness dispersion value, variation coefficient thereof, and average circularity of the magnetic toner are measured with a flow-type particle image analyzer "FPIA-3000" (manufactured by Sysmex Corp.) under the measurement and analysis conditions used at the time of calibration operation.

The specific measurement method is described hereinbelow.

First, about 20 mL of ion exchange water from which solid impurities and the like have been removed in advance is placed in a glass container. About 0.2 mL of a diluted solution prepared by diluting "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with about three-fold mass of ion exchange water is added as a dispersing agent thereto. Further, about 0.02 g of a measurement sample is added, and dispersion treatment is performed for 2 min using an ultrasonic wave disperser to obtain a dispersion solution for measurement. At that time, the dispersion solution is suitably cooled to a temperature of from 10° C. to 40° C. As the ultrasonic wave disperser, a table-top type ultrasonic cleaner disperser ("VS-150" (manufactured by VELVO-CLEAR Co.)) having an oscillation frequency of 50 kHz and an electric output of 150 W is used, a predetermined amount of ion exchange water is placed into a water tank, and about 2 mL of the CONTAMINON N is added to the water tank.

For measurement, the flow type particle image analyzer equipped with "LUCPLFLN" (magnification 20×, numerical aperture 0.40) as the objective lens is used, and a particle sheath "PSE-900A" (manufactured by Sysmex Corporation) is used as a sheath liquid. The dispersion solution prepared according to the procedure is introduced into the flow type particle image analyzer, and 2,000 magnetic toner particles are measured in an HPF measurement mode and a total count mode. From the results, the average brightness, brightness dispersion value, and average circularity of the magnetic toner are calculated.

The average brightness at Dn of the magnetic toner is a value obtained by calculation of the average brightness in which the circle-equivalent diameter of the flow type particle image analyzer is limited to the range from Dn−0.500 (μm) to Dn+0.500 (μm) with respect to the result of the number average particle diameter (Dn) of the magnetic toner.

CV1 is a value obtained by calculation of the variation coefficient of brightness dispersion value in which the circle-equivalent diameter of the flow type particle image analyzer is limited to the range from Dn−0.500 (μm) to Dn+0.500 (μm) with respect to the result of the number average particle diameter (Dn) of the magnetic toner in the measurement result of the brightness dispersion value.

CV2 is a value obtained by calculation of the variation coefficient of brightness dispersion value in which the circle-equivalent diameter of the flow type particle image analyzer is limited to the range from Dn−1.500 (μm) to Dn−0.500 (μm) with respect to the result of the number average particle diameter (Dn) of the magnetic toner in the measurement result of the brightness dispersion value.

In the measurement, automatic focusing is performed using standard latex particles (for example, "RESEARCH AND TEST PARTICLES Latex Microsphere Suspensions 5100A" manufactured by Duke Scientific Inc. which are diluted with ion exchange water) before the start of the measurement. After that, it is preferable to perform focusing every 2 h from the start of the measurement.

The flow type particle image analyzer used in this case was calibrated by Sysmex Corporation and provided with a calibration certificate issued by Sysmex Corporation.

The measurement is performed under the measurement and analysis conditions at the time of receiving the calibration certification, except that the analysis particle diameter is limited to the circle-equivalent diameter of 1.977 μm or more to less than 39.54 μm.

Method for Measuring Peak Temperature (or Melting Point) of Maximum Endothermic Peak The peak temperature of the maximum endothermic peak of a material such as crystalline polyester is measured under the following conditions using a differential scanning calorimeter (DSC) Q2000 (manufactured by TA Instruments).

Temperature rise rate: 10° C./min

Measurement start temperature: 20° C.

Measurement end temperature: 180° C.

The melting points of indium and zinc are used for temperature correction of the device detection unit, and the melting heat of indium is used for correction of heat quantity.

Specifically, about 5 mg of a sample is precisely weighed, placed in an aluminum pan, and measured once. An empty aluminum pan is used as a reference. The peak temperature of the maximum endothermic peak at that time is taken as the melting point.

Method for Measuring Glass Transition Temperature (Tg)

The glass transition temperature of the magnetic toner or resin can be determined from a reversing heat flow curve at the time of temperature rise obtained by differential scanning calorimetry when measuring the peak temperature of the maximum endothermic peak. The glass transition temperature is a temperature (° C.) at the point where a straight line, which is equidistant in the ordinate direction from the straight line obtained by extending the baseline before and after a specific heat change, and the curve of the stepwise change portion of the glass transition in the reversing heat flow curve cross each other.

Method for Measuring Number Average Molecular Weight (Mn), Weight Average Molecular Weight (Mw) and Peak Molecular Weight (Mp) of Resin etc.

The number average molecular weight (Mn), weight average molecular weight (Mw) and peak molecular weight (Mp) of the resin and other materials are measured using gel permeation chromatography (GPC) in the following manner.

(1) Preparation of Measurement Sample

A sample and tetrahydrofuran (THF) are mixed at a concentration of 5.0 mg/mL. The mixture is allowed to stand at room temperature for 5 h to 6 h and then shaken thoroughly, and the sample and THF are mixed well till the sample aggregates are loosened. The components are thereafter allowed to stand for 12 h or more at room temperature. At this time, the time from the start of mixing of the sample and THF to the end of standing is set to be 72 h or more to obtain tetrahydrofuran (THF) soluble matter of the sample.

Subsequent filtration through a solvent-resistant membrane filter (pore size: 0.45 μm to 0.50 μm, Myshory Disc H-25-2 (manufactured by Tosoh Corporation)) produces a sample solution.

(2) Measurement of Sample

Measurement is performed under the following conditions using the obtained sample solution.

Device: high-speed GPC device LC-GPC 150C (manufactured by Waters Co.)

Column: 7 series of Shodex GPC KF-801, 802, 803, 804, 805, 806, 807 (manufactured by Showa Denko K. K.)

Mobile phase: THF

Flow rate: 1.0 mL/min

Column temperature: 40° C.

Sample injection volume: 100 μL

Detector: RI (refractive index) detector

When measuring the molecular weight of the sample, the molecular weight distribution of the sample is calculated from the relationship between the logarithmic value of the calibration curve prepared using several types of monodispersed polystyrene standard samples and the count number.

Samples produced by Pressure Chemical Co. or Toyo Soda Industry Co., Ltd. and having a molecular weight of $6.0\times10^2$, $2.1\times10^3$, $4.0\times10^3$, $1.75\times10^4$, $5.1\times10^4$, $1\times10^5$, $3.9\times10^5$, $8.6\times10^5$, $2.0\times10^6$, and $4.48\times10^6$ are used as standard polystyrene samples for preparation of the calibration curve.

Method for Measuring Particle Diameter of Dispersion in Fine Particle-Dispersed Solution The particle diameter of the dispersion of each of the fine particle-dispersed solutions such as the resin particle-dispersed solution and the magnetic body-dispersed solution is measured using a laser diffraction/scattering particle size distribution measuring apparatus. Specifically, the measurement is performed in accordance with JIS Z 8825-1 (2001).

As a measuring apparatus, a laser diffraction/scattering type particle size distribution measuring apparatus "LA-920" (manufactured by Horiba, Ltd.) is used.

For setting of measurement conditions and analysis of measurement data, dedicated software "HORIBA LA-920 for Windows (registered trademark) WET (LA-920) Ver. 2.02" provided with the LA-920 is used. In addition, ion exchange water from which solid impurities and the like have been removed in advance is used as a measurement solvent. The measurement procedure is as follows.

(1) A batch cell holder is attached to the LA-920.

(2) A predetermined amount of ion exchange water is poured into a batch cell, and the batch cell is set in the batch cell holder.

(3) The inside of the batch cell is stirred using a dedicated stirrer tip.

(4) The "REFRACTIVE INDEX" button on the "DISPLAY CONDITION SETTING" screen is pushed, and the relative refractive index is set to a value corresponding to the particle.

(5) On the "DISPLAY CONDITION SETTING" screen, the particle diameter standard is set as the volume standard.

(6) After performing warm-up operation for 1 h or more, adjustment of the optical axis, fine adjustment of the optical axis, and blank measurement are performed.

(7) A total of 3 mL of the fine particle-dispersed solution is placed in a 100 mL flat bottom beaker made of glass. Then, 57 ml of ion exchange water is added to dilute the fine particle-dispersed solution. Then, about 0.3 mL of a diluted solution prepared by diluting "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with about three-fold mass of ion exchange water is added as a dispersing agent thereto.

(8) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchange water is placed in the water tank of the ultrasonic disperser, and about 2 mL of CONTAMINON N is added to the water tank.

(9) The beaker of (7) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(10) The ultrasonic dispersion process is further continued for 60 sec. In the ultrasonic dispersion, the water temperature in the water tank is appropriately adjusted to a temperature from 10° C. to 40° C.

(11) The fine particle-dispersed solution prepared in (10) hereinabove is added little by little to the batch cell, while taking care not to cause air bubbles, so that the transmittance of the tungsten lamp is adjusted to 90% to 95%. Then, the particle size distribution is measured. Based on the volume-based particle size distribution data thus obtained, the particle size of the dispersion in the fine particle-dispersed solution is calculated.

Method for Calculating Occupied Area Ratio of Magnetic Bodies in Magnetic Toner Particle, Average Value Thereof and Variation Coefficient (CV3) Thereof The occupied area ratio of the magnetic bodies in the magnetic toner particle, the average value thereof and the variation coefficient (CV3) thereof are calculated as follows.

First, a transmission electron microscope (TEM) is used to acquire an image of the cross section of the magnetic toner particle. The obtained cross-sectional image is used to obtain a frequency histogram of the occupied area ratio of the magnetic bodies in each divided grid on the basis of a division method.

Then, the variation coefficient of the occupancy area ratio of each obtained division grid is determined and taken as the variation coefficient (CV3) of the occupancy area ratio.

Specifically, first, magnetic toner is compression molded into a tablet. The tablet is obtained by filling a tablet former having a diameter of 8 mm with 100 mg of the magnetic toner, applying a force of 35 kN and allowing to stand for 1 min.

The obtained tablet is cut with an ultrasonic ultramicrotome (Leica Co., Ltd., UC7) to obtain a thin sample having a thickness of 250 nm.

A STEM image of the thin sample obtained is captured using a transmission electron microscope (JEOL Co., JEM 2800).

The probe size used for capturing the STEM image is 1.0 nm, and the image size is 1024×1024 pixels. At this time, by adjusting the Contrast of the bright field image Detector Control panel to 1425, the Brightness to 3750, the Contrast to the Image Control panel to 0.0, the Brightness to 0.5, and the Gammma to 1.00, an image can be captured with only the magnetic body portion being dark. By the setting, a STEM image suitable for image processing can be obtained.

The obtained STEM image is digitized using an image processing apparatus (Nireco, Inc., LUZEX AP).

Specifically, a frequency histogram of the occupied area ratio of the magnetic body in a square grid of 0.8 μm on one side is obtained by the division method. At this time, the grade interval of the histogram is 5%.

Further, the variation coefficient is obtained from the obtained occupied area ratio of each section grid and taken as the variation coefficient CV3 of the occupied area ratio. In addition, the average value of the occupied area ratio is an average of the occupied area ratios of the respective division grids.

Method for Calculating Number Average Diameter of Domains of Crystalline Polyester The magnetic toner is embedded in a visible light-curable embedding resin (D-800, manufactured by Nisshin EM Co., Ltd.), cut with an ultrasonic ultramicrotome (Leica Co., Ltd., UC7) into thin pieces having a thickness of 250 nm and Ru-stained with a vacuum staining device (manufactured by Filgen, Inc.).

Thereafter, using a transmission electron microscope (H7500, manufactured by Hitachi High-Technologies Corporation), cross-sectional observation of the obtained magnetic toner particles is performed at an acceleration voltage of 120 kV.

As for the cross section of the magnetic toner particles to be observed, ten particles within ±2.0 μm from the number average particle diameter of the magnetic toner particles are selected and images thereof are captured to obtain cross-sectional images.

In addition, compared with the amorphous resin and magnetic bodies, staining of the crystalline polyester with Ru does not advance, and the crystalline polyester looks from black to gray in this cross-sectional image.

In the cross-sectional image, 30 domains of the crystalline polyester having a major axis of 20 nm or more are randomly selected, the average value of the major and minor axes is taken as the domain diameter, and the average value for 30 domains is taken as the number average diameter of crystalline polyester domains. The selection of domains may not be in the same magnetic toner particle.

Measurement of Dielectric Loss Tangent of Magnetic Toner

The dielectric properties of the magnetic toner are measured by the following method.

A total of 1 g of the magnetic toner is weighed, and a load of 20 kPa is applied for 1 min to form a disc-shaped measurement sample having a diameter of 25 mm and a thickness of 1.5±0.5 mm.

The measurement sample is mounted on ARES (manufactured by TA Instruments) equipped with a dielectric measurement jig (electrode) having a diameter of 25 mm. In a state in which a load of 250 g/cm$^2$ is applied at a measurement temperature of 30° C., the dielectric loss tangent is calculated from the measured value of the complex dielectric constant at 100 kHz and a temperature of 30° C. by using a 4284A Precision LCR meter (manufactured by Hewlett-Packard).

Method for Measuring Powder Dynamic Viscoelasticity of Magnetic Toner

The measurement is performed using a dynamic viscoelasticity measuring device DMA 8000 (manufactured by Perkin Elmer Inc.).

Measuring jig: material pocket (P/N: N533-0322)

A total of 80 mg of the magnetic toner is held in the material pocket, and the material pocket is attached to a single cantilever and secured by tightening a screw with a torque wrench.

Measurement is performed using dedicated software "DMA Control Software" (manufactured by Perkin Elmer Inc.). The measurement conditions are as follows.

Oven: Standard Air Oven

Measurement type: temperature scan

DMA condition: single frequency/strain (G)

Frequency: 1 Hz

Strain: 0.05 mm

Starting temperature: 25° C.

End temperature: 180° C.

Scanning speed: 20° C./min

Deformation mode: single cantilever (B)

Cross section: rectangular (R)

Specimen size (length): 17.5 mm

Specimen size (width): 7.5 mm

Specimen size (thickness): 1.5 mm

From the curve of storage elastic modulus E' obtained by the measurement, E' (40) and E'(85) are read, and the value of [E'(40)−E'(85)]×100/E'(40) is calculated.

EXAMPLES

The present invention will be described hereinbelow in greater detail by way of the following Examples and Comparative Examples, but the present invention is not limited thereto. In the Examples and Comparative Examples, the number of parts and % are all based on mass unless stated otherwise.

Production Example of Amorphous Polyester A1

| | |
|---|---|
| Terephthalic acid | 30.0 parts |
| Isophthalic acid | 12.0 parts |
| Dodecenyl succinic acid | 37.0 parts |
| Trimellitic acid | 4.2 parts |
| Bisphenol A ethylene oxide (2 moles) adduct | 80.0 parts |
| Bisphenol A propylene oxide (2 moles) adduct | 74.0 parts |
| Dibutyltin oxide | 0.1 parts |

The above materials were placed in a heat-dried two-necked flask, nitrogen gas was introduced into the vessel to maintain the inert atmosphere, and the temperature was raised under stirring. Thereafter, a polycondensation reaction was carried out at 150° C. to 230° C. for about 12 h, and the pressure was gradually reduced at 210° C. to 250° C. to obtain an amorphous polyester A1.

The number average molecular weight (Mn) of the amorphous polyester A1 was 18,200, the weight average molecular weight (Mw) was 74,100, and the glass transition temperature (Tg) was 58.6° C.

Production Examples of Amorphous Polyesters A2 to A4

Amorphous polyesters A2 to A4 were obtained in the same manner as in Production Example of Amorphous Polyester A1, except that the formulation was changed as shown in Table 1.

TABLE 1

| Resin No. | Terephthalic acid (parts) | Isophthalic acid (parts) | Sebacic acid (parts) | Dodecenyl succinic acid (parts) | Trimellitic acid (parts) | BPA-EO (parts) | BPA-PO (parts) | Molecular weight Mw |
|---|---|---|---|---|---|---|---|---|
| A1 | 30.0 | 12.0 | 0.0 | 37.0 | 4.2 | 80.0 | 74.0 | 74100 |
| A2 | 48.0 | 0.0 | 0.0 | 17.0 | 8.3 | 80.0 | 74.0 | 80500 |
| A3 | 48.0 | 0.0 | 0.0 | 11.5 | 12.5 | 80.0 | 74.0 | 128900 |
| A4 | 30.0 | 0.0 | 15.6 | 37.0 | 4.2 | 80.0 | 74.0 | 14600 |

In the table, the abbreviations are as follows.

BPA-EO: bisphenol A ethylene oxide (2 moles) adduct

BPA-PO: bisphenol A propylene oxide (2 mol) adduct

Production Example of Crystalline Polyester B1

| | |
|---|---|
| 1,10-Decanedicarboxylic acid | 85.0 parts |
| 1,9-Nonanediol | 80.0 parts |
| Dibutyltin oxide | 0.1 part |

The above materials were placed in a heat-dried two-necked flask, nitrogen gas was introduced into the vessel to maintain the inert atmosphere, and the temperature was raised under stirring. Then, stirring was performed at 180° C. for 6 h. Thereafter, the temperature was gradually raised to 230° C. under reduced pressure while the stirring was continued, and the temperature was further maintained for 2 h. A crystalline polyester B1 was synthesized by cooling with air and stopping the reaction once a viscous state was reached. The weight average molecular weight (Mw) of crystalline polyester B1 was 26,700, and the melting point was 66.0° C.

Production Examples of Crystalline Polyesters B2 to B5

Crystalline Polyesters B2 to B5 were obtained in the same manner as in Production Example of Crystalline Polyester B1, except that the formulation was changed as shown in Table 2. Each of these crystalline polyesters had a distinct melting point.

TABLE 2

| Resin No. | 1,9-Nonanediol (parts) | 1,2-Ethanediol (parts) | 1,6-Hexanediol (parts) | 1,10-Decanedi-carboxylic acid (parts) | Molecular weight Mw |
|---|---|---|---|---|---|
| B1 | 80.0 | — | — | 85.0 | 26700 |
| B2 | 70.0 | — | — | 73.0 | 18500 |
| B3 | 60.0 | — | — | 63.0 | 14200 |
| B4 | — | 33.0 | — | 70.0 | 29100 |
| B5 | — | — | 56.0 | 79.0 | 22500 |

Production Example of Resin Particle-Dispersed Solution D-1

A total of 100.0 parts of ethyl acetate, 30.0 parts of the polyester A1, 0.3 parts of 0.1 mol/L sodium hydroxide, and 0.2 parts of an anionic surfactant (Neogen RK, manufactured by Daiichi Kogyo Seiyaku Co., Ltd.) were placed in a beaker equipped with a stirrer, heating to 60.0° C. was performed, and stirring was continued until complete dissolution to prepare a resin solution D-1.

A total of 90.0 parts of ion exchange water was gradually added while further stirring the resin solution D-1, phase inversion emulsification was carried out, and solvent removal was performed to obtain a resin particle-dispersed solution D-1 (solid fraction concentration: 25.0% by mass).

The volume average particle diameter of the resin particles in the resin particle-dispersed solution D-1 was 0.19 μm.

Production Examples of Resin Particle-Dispersed Solutions D-2 to D-10

Resin particle-dispersed solutions D-2 to D-10 were obtained in the same manner as in Production Example of Particle-Dispersed Solution D-1, except that the formulation was changed as shown in Table 3. The formulations and physical properties are shown in Table 3.

TABLE 3

| Resin Particle-dispersed solution | Polyester resin No. | Polyester resin Parts | Ethyl acetate Parts | Particle diameter (μm) |
|---|---|---|---|---|
| D-1 | A1 | 30.0 | 100.0 | 0.19 |
| D-2 | A2 | 30.0 | 100.0 | 0.18 |
| D-3 | A3 | 30.0 | 100.0 | 0.22 |
| D-4 | A4 | 30.0 | 100.0 | 0.22 |
| D-5 | B1 | 30.0 | 100.0 | 0.19 |
| D-6 | B1 | 30.0 | 200.0 | 0.10 |
| D-7 | B2 | 30.0 | 100.0 | 0.21 |
| D-8 | B3 | 30.0 | 100.0 | 0.20 |
| D-9 | B4 | 30.0 | 100.0 | 0.22 |
| D-10 | B5 | 30.0 | 200.0 | 0.21 |

Production Example of Wax-Dispersed Solution W-1

| | |
|---|---|
| Behenyl behenate | 50.0 parts |
| Anionic surfactant (Neogen RK, manufactured by Daiichi Kogyo Seiyaku Co., Ltd.) | 0.3 parts |
| Ion exchange water | 150.0 parts |

The above components were mixed, heated to 95° C., and dispersed using a homogenizer (ULTRA TURRAX T50, manufactured by IKA Corporation). Thereafter, dispersion was carried out with a Manton-Gaulin high-pressure homogenizer (manufactured by Gaulin Co., Ltd.) to prepare a wax-dispersed solution W-1 (solid fraction concentration: 25% by mass) in which wax particles were dispersed. The volume average particle size of the obtained wax particles was 0.22 μm.

Production Example of Magnetic Body 1

A total of 55 L of a 4.0 mol/L sodium hydroxide aqueous solution was mixed and stirred with 50 liters of a ferrous sulfate aqueous solution including 2.0 mol/L of $Fe^{2+}$ to obtain a ferrous salt aqueous solution including a ferrous hydroxide colloid. The aqueous solution was maintained at 85° C., and an oxidation reaction was carried out while blowing in air at 20 L/min to obtain a slurry including core particles.

The obtained slurry was filtered and washed with a filter press, and the core particles were then re-dispersed in water. A total of 0.20% by mass of sodium silicate in terms of silicon per 100 parts of core particles was added to the obtained re-slurry solution, the pH of the slurry solution was adjusted to 6.0, and stirring was performed to obtain magnetic iron oxide particles having a silicon-rich surface.

The obtained slurry solution was filtered with a filter press, washed, and re-slurried with ion exchange water. To this re-slurry solution (solid fraction: 50 parts/L), 500 parts (10% by mass with respect to the magnetic iron oxide) of ion exchange resin SK110 (manufactured by Mitsubishi Chemical Co., Ltd.) was added, and stirring was carried out for 2 h for ion exchange. Thereafter, the ion exchange resin was removed by filtration through a mesh, followed by filtration and washing with a filter press, drying and pulverization to obtain a magnetic body 1 having a number average particle diameter of primary particles of 0.21 μm.

Production Example of Magnetic Bodies 2 and 3

Magnetic bodies 2 and 3 were obtained in the same manner as in the Production Example of Magnetic Body 1 except that the blowing amount of air and the oxidation reaction time were adjusted. Table 4 shows the physical properties of each magnetic body.

TABLE 4

| | Number average particle diameter of primary particles (μm) |
|---|---|
| Magnetic body 1 | 0.21 |
| Magnetic body 2 | 0.30 |
| Magnetic body 3 | 0.15 |

Production Example of Magnetic Body-Dispersed Solution M-1

| | |
|---|---|
| Magnetic body 1 | 25.0 parts |
| Ion exchange water | 75.0 parts |

The above materials were mixed and dispersed for 10 min at 8000 rpm using a homogenizer (ULTRA TURRAX T50, manufactured by IKA Corporation) to obtain a magnetic body-dispersed solution M-1. The volume average particle diameter of the magnetic bodies in the magnetic body-dispersed solution M-1 was 0.23 μm.

Production Example of Magnetic Body-Dispersed Solutions M-2 and M-3

Magnetic body-dispersed solutions M-2 and M3 were produced in the same manner as in the Production Example of Magnetic Body-Dispersed Solution M-1, except that the magnetic body 1 was changed to the magnetic bodies 2 and 3, respectively. The volume average particle diameter of the magnetic bodies in the obtained magnetic body-dispersed solution M-2 was 0.18 μm, and the volume average particle size of the magnetic bodies in the magnetic body-dispersed solution M-3 was 0.35 μm.

Production Example of Magnetic Toner Particles 1

| | |
|---|---|
| Resin particle-dispersed solution D-1 (solid fraction 25.0% by mass) | 150.0 parts |

-continued

| | |
|---|---|
| Resin particle-dispersed solution D-5 (solid fraction 25.0% by mass) | 25.0 parts |
| Wax-dispersed solution W-1 (solid fraction 25.0% by mass) | 15.0 parts |
| Magnetic body-dispersed solution M-1 (solid fraction 25.0% by mass) | 105.0 parts |

The above materials were loaded into a beaker, adjusted to a total number of parts of water of 250 parts, and then adjusted to 30.0° C. Then, the materials were mixed by stirring for 1 min at 5000 rpm using a homogenizer (ULTRA TURRAX T50, manufactured by IKA Corporation).

Furthermore, 10.0 parts of 2.0% by mass aqueous solution of magnesium sulfate was gradually added as a flocculant.

The raw material-dispersed solution was transferred to a polymerization kettle equipped with a stirrer and a thermometer, and was heated to 50.0° C. with a mantle heater and stirred to promote the growth of aggregated particles.

After 60 min had elapsed, 200.0 parts of a 5.0% by mass aqueous solution of ethylenediaminetetraacetic acid (EDTA) was added to prepare an aggregated particle-dispersed solution 1.

Subsequently, the aggregated particle-dispersed solution 1 was adjusted to pH 8.0 by using a 0.1 mol/L sodium hydroxide aqueous solution, and then the aggregated particle-dispersed solution 1 was heated to 80.0° C. and allowed to stand for 180 min to coalesce the aggregated particles.

After 180 min, a toner particle-dispersed solution 1 in which toner particles were dispersed was obtained. After cooling at a temperature lowering rate of 1.0° C./min, the toner particle-dispersed solution 1 was filtered and washed with ion exchange water, and when the conductivity of the filtrate became 50 mS or less, the cake-shaped toner particles were removed. Next, the cake-shaped toner particles were loaded in ion exchange water taken in an amount 20 times the mass of the toner particles and stirred by a three-one motor. When the toner particles were sufficiently loosened, re-filtration, washing with flowing water, and solid-liquid separation were performed. The resulting cake-shaped toner particles were pulverized in a sample mill and dried in an oven at 40° C. for 24 h. Further, the obtained powder was pulverized with a sample mill, and additional vacuum drying was performed in an oven at 40° C. for 5 h to obtain magnetic toner particles 1.

Production Example of Magnetic Toner 1

A total of 0.3 parts of sol-gel silica fine particles having a number average particle diameter of primary particles of 115 nm were added to 100 parts of the magnetic toner particles 1, and mixed using an FM mixer (manufactured by Nippon Coke Kogyo Co., Ltd.). Thereafter, 0.9 parts of hydrophobic silica fine particles that were obtained by treating silica fine particles having a number average particle diameter of primary particles of 12 nm with hexamethyldisilazane and then treating with silicone oil and that had a BET specific surface area value of 120 $m^2/g$ after the treatment were added, and mixing was similarly performed using the FM mixer (manufactured by Japan Coke Industry Co., Ltd.) to obtain a magnetic toner 1.

The following results relating to the obtained magnetic toner 1 are shown in Table 6.

Number average particle diameter (Dn), average brightness at Dn [simply referred to as average brightness in the table], CV2/CV1, average value of occupied area ratio of magnetic body [denoted by A in the table], average circularity [referred to as circularity in the table], number average diameter of domains of crystalline polyester [denoted by B in the table], dielectric loss tangent, storage elastic modulus E'(85) at 85° C. in powder dynamic viscoelasticity measurement [simply denoted by E'(85) in the table], relationship [E'(40)−E'(85)]×100/E'(40) between the storage elastic modulus E'(40) at 40° C. in powder dynamic viscoelasticity measurement and E'(85) [denoted by C in the table], and amount (% by mass) of crystalline polyester (CPES).

Example 1

Image Forming Apparatus

The one-component contact development type LaserJet Pro M12 (manufactured by Hewlett Packard Co.) was used after being modified to 200 mm/sec, which is higher than the original process speed.

Further, the evaluation results are shown in Table 7. In addition, the evaluation method and evaluation criteria in each evaluation are presented hereinbelow.

Evaluation of Image Density Under Low-Temperature and Low-Humidity Environment

A total of 100 g of the magnetic toner 1 was filled in the apparatus modified as described above, and a repeated use test was performed under a low temperature and low humidity environment (15.0° C./10.0% RH).

As an output image for the test, 4000 prints of horizontal line images with a print percentage of 1% were printed by intermittent sheet passing.

In addition, business 4200 (manufactured by Xerox Co., Ltd.) with a basis weight of 75 g/m$^2$ was used for the evaluation paper to be used for a test.

As for the image density, a solid black image portion was formed, and the density of the solid black image was measured with a Macbeth reflection densitometer (manufactured by Macbeth Co.).

The criteria for determining the reflection density of the solid black image before the repeated use are as follows.

Evaluation Criteria

A: 1.45 or more

B: 1.40 or more and less than 1.45

C: 1.35 or more and less than 1.40

D: less than 1.35

The criteria for determining the image density change in the second half of the repeated use are as follows.

The smaller the difference between the reflection density of the solid black image before the repeated use and the reflection density of the solid black image output after printing 4000 prints in the repeated use test, the better.

Evaluation Criteria

A: difference in density is less than 0.10

B: difference in density is 0.10 or more and less than 0.15

C: difference in density is 0.15 or more and less than 0.20

D: difference in density is 0.20 or more

Evaluation of Electrostatic Offset Under Low-Temperature and Low-Humidity Environment In the evaluation, the temperature of the fixing unit of the image forming apparatus was set at 180° C., a 3 cm square isolated dot image (set to an image density of from 0.75 to 0.80) was outputted to Fox RIVER BOND paper (90 g/m$^2$) that was allowed to stand for 24 h under the low-temperature and low-humidity environment (15.0° C./10.0% RH), and then the level of electrostatic offset generated in a solid white area downstream of the dot image was visually determined.

Evaluation Criteria

A: cannot be confirmed visually

B: very slight level can be confirmed

C: an offset part can be visually confirmed, but there is also a part that is not offset D: 3 cm square can be clearly identified Evaluation of Fixing Separability The evaluation was performed under a normal temperature and normal humidity environment (25.0° C./50% RH), by using the abovementioned image forming apparatus and business 4200 (manufactured by Xerox Co.) having a basis weight of 75 g/m$^2$ as evaluation paper.

Then, a solid black image having a length of 5.0 cm and a width of 20.0 cm was formed using the filled toner on the recording medium so as to have a toner laid-on level of 0.90 mg/cm$^2$. At this time, image formation was performed while changing the range of the margin portion at the upper end in the sheet passing direction.

The unfixed image was fixed at a set temperature of 160° C. The minimum margin at which the paper did not wrap around the fixing roller was evaluated according to the following criteria.

Evaluation Criteria

A: no wrapping

B: the margin from the upper end is 1 mm or more and less than 4 mm

C: the margin from the upper end is 4 mm or more and less than 7 mm

D: the margin from the upper end is 7 mm or more

Evaluation of Low-Temperature Fixability

The evaluation was performed under a normal temperature and normal humidity environment (25.0° C./50% RH), by using the abovementioned image forming apparatus and business 4200 (manufactured by Xerox Co.) having a basis weight of 75 g/m$^2$ as evaluation paper.

Speckling

The evaluation image was a solid black image, and the set temperature of the fixing unit of the image forming apparatus was adjusted to 140° C. During the evaluation, the fixing device was removed, and the following evaluation was carried out with the fixing device sufficiently cooled using a fan or the like. By sufficiently cooling the fixing device after the evaluation, the temperature of the fixing nip portion which has been raised after the image output is cooled, so that the fixability of the toner can be strictly evaluated with satisfactory reproducibility.

The toner 1 was used to output a solid black image on the above-mentioned paper in the state where the fixing device was sufficiently cooled. At this time, the toner laid-on level on the paper was adjusted to be 0.90 mg/cm$^2$. In the evaluation results of toner 1, a satisfactory solid black image with no speckling was obtained. The determination criteria for the speckling are described below.

The level of speckling was visually evaluated for the solid black image outputted according to the above-mentioned procedure. The determination criteria are as follows.

A: speckling is completely absent

B: some speckling is seen upon close examination

C: speckling is seen, but is not conspicuous

D: speckling is conspicuous

Evaluation of Paper Adhesion

In the evaluation, the evaluation image was a halftone image, and the image was outputted by decreasing the set temperature of the fixing unit of the image forming apparatus from 200° C. by 5° C. Then, the fixed image was rubbed ten times with silbon paper under a load of 55 g/cm$^2$, and the temperature at which the density reduction rate of the fixed image after rubbing exceeded 10% was taken as the lower limit fixing temperature.

The low-temperature fixability was evaluated according to the following determination criteria. The lower the fixing lower limit temperature, the better the low-temperature fixability.

Evaluation Criteria

A: less than 150° C.

B: 150° C. or more and less than 160° C.

C: 160° C. or more and less than 175° C.

D: 175° C. or more

Production Example of Magnetic Toner Particles 2 Pre-aggregation Step

Magnetic body-dispersed solution M-1 (solid fraction 25.0% by mass) 105.0 parts

The above material was loaded into a beaker, adjusted to 30.0° C., and then stirred for 1 min at 5000 rpm using a homogenizer (ULTRA TURRAX T50, manufactured by IKA Corporation). Furthermore, 1.0 part of 2.0% by mass aqueous solution of magnesium sulfate was gradually added as a flocculant, followed by stirring for 1 min.

| Aggregation Step | |
|---|---|
| Resin particle-dispersed solution D-1 (solid fraction 25.0% by mass) | 150.0 parts |
| Resin particle-dispersed solution D-5 (solid fraction 25.0% by mass) | 10.0 parts |
| Wax-dispersed solution W-1 (solid fraction 25.0% by mass) | 15.0 parts |

The above materials were loaded into the above beaker, adjusted to a total number of parts of water of 250 parts, and then mixed by stirring for 1 min at 5000 rpm.

Furthermore, 9.0 parts of 2.0% by mass aqueous solution of magnesium sulfate was gradually added as a flocculant, followed by stirring for 1 min.

The raw material-dispersed solution was transferred to a polymerization kettle equipped with a stirrer and a thermometer, and was heated to 50.0° C. with a mantle heater and stirred to promote the growth of aggregated particles.

After 59 min had elapsed, 200.0 parts of a 5.0% by mass aqueous solution of ethylenediaminetetraacetic acid (EDTA) was added to prepare an aggregated particle-dispersed solution 2.

Subsequently, the aggregated particle-dispersed solution 2 was adjusted to pH 8.0 by using a 0.1 mol/L sodium hydroxide aqueous solution, and then the aggregated particle-dispersed solution 2 was heated to 80.0° C. and allowed to stand for 180 min to coalesce the aggregated particles.

After 180 min, a toner particle-dispersed solution 2 in which toner particles were dispersed was obtained. After cooling at a temperature lowering rate of 1.0° C./min, the toner particle-dispersed solution 2 was filtered and washed with ion exchange water, and when the conductivity of the filtrate became 50 mS or less, the cake-shaped toner particles were removed. Next, the cake-shaped toner particles were loaded in ion exchange water taken in an amount 20 times the mass of the toner particles and stirred by a three-one motor. When the toner particles were sufficiently loosened, re-filtration, washing with flowing water, and solid-liquid separation were performed. The resulting cake-shaped toner particles were pulverized in a sample mill and dried in an oven at 40° C. for 24 h. Further, the obtained powder was pulverized with a sample mill, and additional vacuum drying was performed in an oven at 40° C. for 5 h to obtain magnetic toner particles 2.

Production Example of Magnetic Toner Particles 3 to 28 and 30 to 32

Magnetic toner particles 3, 5 to 8, 10 to 24, 26, 28 and 31 to 32 were obtained in the same manner as in the Production Example of Magnetic Toner Particles 1 except that the conditions were changed to those described in Tables 5-1 and 5-2.

Meanwhile, magnetic toner particles 4, 9, 25, 27, and 30 were obtained in the same manner as in the Production Example of Magnetic Toner Particles 2 except that the conditions were changed to those described in Tables 5-1 and 5-2.

In the production examples of the magnetic toner particles 3, 5, 6, 10, 23 and 28, 0.2 part of a surfactant (NOIGEN TDS-200, Daiichi Kogyo Seiyaku Co., Ltd.) was added in the first aggregation step, and then a flocculant was added.

In the production examples of the magnetic toner particles 8, 16, 17, 22 to 24, 26, 28, after the first aggregation step in which the growth of the aggregated particles at 50.0° C. was promoted, a second aggregation step was carried out in which the particle-dispersed solutions described in Tables 5-1 and 5-2 were added and the growth of the aggregated particles was again promoted at 50.0° C. The addition of EDTA and subsequent steps were performed after the second aggregation step.

TABLE 5-1

| | Pre-aggregation step | | | | First aggregation step | | | | | | Second aggregation step | | | Aging step | | |
|---|---|---|---|---|---|---|---|---|---|---|---|---|---|---|---|---|
| Toner particle No. | Dispersed solution No. | Parts | Flocculant (parts) | AT | Dispersed solution No. | Parts | Additional surfactant | Parts | Flocculant (parts) | AT | Dispersed solution No. | Parts | AT | CA (parts) | pH | Aging time |
| 1 | | | | | D-1 | 150.0 | | | 10.0 | 60 | | | | 200 | 8 | 180 |
| | | | | | D-5 | 25.0 | | | | | | | | | | |
| | | | | | W-1 | 15.0 | | | | | | | | | | |
| | | | | | M-1 | 105.0 | | | | | | | | | | |
| 2 | | | 1.0 | 1 | D-1 | 150.0 | | | 9.0 | 59 | | | | 200 | 8 | 180 |
| | | | | | D-5 | 10.0 | | | | | | | | | | |
| | | | | | W-1 | 15.0 | | | | | | | | | | |
| | M-1 | 105.0 | | | | | | | | | | | | | | |
| 3 | | | | | D-1 | 150.0 | NOIGEN | 0.2 | 10.0 | 60 | | | | 150 | 10 | 180 |
| | | | | | D-5 | 10.0 | TDS-200D | | | | | | | | | |
| | | | | | W-1 | 15.0 | | | | | | | | | | |
| | | | | | M-1 | 105.0 | | | | | | | | | | |
| 4 | | | 1.0 | 1 | D-1 | 150.0 | | | 9.0 | 59 | | | | 200 | 8 | 180 |
| | | | | | D-5 | 45.0 | | | | | | | | | | |

TABLE 5-1-continued

| Toner particle No. | Pre-aggregation step: Dispersed solution No. | Parts | Flocculant (parts) | AT | First aggregation step: Dispersed solution No. | Parts | Additional surfactant | Parts | Flocculant (parts) | AT | Second aggregation step: Dispersed solution No. | Parts | AT | Aging step: CA (parts) | pH | Aging time |
|---|---|---|---|---|---|---|---|---|---|---|---|---|---|---|---|---|
| | | | | | W-1 | 15.0 | | | | | | | | | | |
| | M-1 | 105.0 | | | | | | | | | | | | | | |
| 5 | | | | | D-1 | 150.0 | NOIGEN | 0.2 | 10.0 | 60 | | | | 150 | 10 | 180 |
| | | | | | D-6 | 25.0 | TDS-200D | | | | | | | | | |
| | | | | | W-1 | 15.0 | | | | | | | | | | |
| | | | | | M-1 | 105.0 | | | | | | | | | | |
| 6 | | | | | D-1 | 150.0 | NOIGEN | 0.2 | 10.0 | 60 | | | | 200 | 8 | 180 |
| | | | | | D-5 | 10.0 | TDS-200D | | | | | | | | | |
| | | | | | W-1 | 15.0 | | | | | | | | | | |
| | | | | | M-1 | 105.0 | | | | | | | | | | |
| 7 | | | | | D-1 | 150.0 | | | 10.0 | 60 | | | | 150 | 10 | 180 |
| | | | | | D-5 | 25.0 | | | | | | | | | | |
| | | | | | W-1 | 15.0 | | | | | | | | | | |
| | | | | | M-1 | 75.0 | | | | | | | | | | |
| 8 | | | | | D-1 | 150.0 | | | 15.0 | 30 | | | 30 | 200 | 8 | 180 |
| | | | | | D-5 | 25.0 | | | | | | | | | | |
| | | | | | W-1 | 15.0 | | | | | | | | | | |
| | | | | | | | | | | | M-1 | 105.0 | | | | |
| 9 | | | 1.0 | 1 | D-1 | 150.0 | | | 9.0 | 59 | | | | 150 | 10 | 180 |
| | | | | | D-5 | 25.0 | | | | | | | | | | |
| | | | | | W-1 | 15.0 | | | | | | | | | | |
| | M-1 | 105.0 | | | | | | | | | | | | | | |
| 10 | | | | | D-1 | 150.0 | NOIGEN | 0.2 | 10.0 | 60 | | | | 150 | 10 | 180 |
| | | | | | D-5 | 25.0 | TDS-200D | | | | | | | | | |
| | | | | | W-1 | 15.0 | | | | | | | | | | |
| | | | | | M-1 | 105.0 | | | | | | | | | | |
| 11 | | | | | D-2 | 150.0 | | | 10.0 | 60 | | | | 200 | 8 | 180 |
| | | | | | D-5 | 25.0 | | | | | | | | | | |
| | | | | | W-1 | 15.0 | | | | | | | | | | |
| | | | | | M-1 | 105.0 | | | | | | | | | | |
| 12 | | | | | D-1 | 150.0 | | | 10.0 | 60 | | | | 150 | 10 | 180 |
| | | | | | D-5 | 60.0 | | | | | | | | | | |
| | | | | | W-1 | 15.0 | | | | | | | | | | |
| | | | | | M-1 | 105.0 | | | | | | | | | | |
| 13 | | | | | D-1 | 150.0 | | | 10.0 | 60 | | | | 150 | 10 | 180 |
| | | | | | D-5 | 45.0 | | | | | | | | | | |
| | | | | | W-1 | 15.0 | | | | | | | | | | |
| | | | | | M-2 | 105.0 | | | | | | | | | | |
| 14 | | | | | D-1 | 150.0 | | | 10.0 | 60 | | | | 200 | 8 | 180 |
| | | | | | D-5 | 25.0 | | | | | | | | | | |
| | | | | | W-1 | 15.0 | | | | | | | | | | |
| | | | | | M-2 | 105.0 | | | | | | | | | | |
| 15 | | | | | D-1 | 150.0 | | | 10.0 | 60 | | | | 200 | 8 | 180 |
| | | | | | D-5 | 25.0 | | | | | | | | | | |
| | | | | | W-1 | 15.0 | | | | | | | | | | |
| | | | | | M-2 | 130.0 | | | | | | | | | | |
| 16 | | | | | D-1 | 150.0 | | | 10.0 | 30 | | | 30 | 200 | 8 | 180 |
| | | | | | D-7 | 25.0 | | | | | | | | | | |
| | | | | | W-1 | 15.0 | | | | | | | | | | |
| | | | | | M-1 | 50.0 | | | | | M-1 | 55.0 | | | | |

In the Table 5-1 and 5-2, "AT" denotes aggregation time (min), "CA" denotes parts of aqueous solution of chelating agent.

TABLE 5-2

| Toner particle No. | Pre-aggregation step: Dispersed solution No. | Parts | Flocculant (parts) | AT | First aggregation step: Dispersed solution No. | Parts | Additional surfactant | Parts | Flocculant (parts) | AT | Second aggregation step: Dispersed solution No. | Parts | AT | Aging step: CA (parts) | pH | Aging time |
|---|---|---|---|---|---|---|---|---|---|---|---|---|---|---|---|---|
| 17 | | | | | D-1 | 150.0 | | | 10.0 | 30 | | | 30 | 200 | 8 | 180 |
| | | | | | D-8 | 25.0 | | | | | | | | | | |
| | | | | | W-1 | 15.0 | | | | | | | | | | |
| | | | | | M-1 | 50.0 | | | | | M-1 | 55.0 | | | | |

TABLE 5-2-continued

| Toner particle No. | Pre-aggregation step: Dispersed solution No. | Parts | Flocculant (parts) | AT | First aggregation step: Dispersed solution No. | Parts | Additional surfactant | Parts | Flocculant (parts) | AT | Second aggregation step: Dispersed solution No. | Parts | AT | Aging step: CA (parts) | pH | Aging time |
|---|---|---|---|---|---|---|---|---|---|---|---|---|---|---|---|---|
| 18 | | | | | D-1 | 150.0 | | | 10.0 | 60 | | | | 200 | 8 | 150 |
| | | | | | D-5 | 25.0 | | | | | | | | | | |
| | | | | | W-1 | 15.0 | | | | | | | | | | |
| | | | | | M-1 | 105.0 | | | | | | | | | | |
| 19 | | | | | D-1 | 150.0 | | | 10.0 | 60 | | | | 200 | 8 | 120 |
| | | | | | D-5 | 25.0 | | | | | | | | | | |
| | | | | | W-1 | 15.0 | | | | | | | | | | |
| | | | | | M-1 | 105.0 | | | | | | | | | | |
| 20 | | | | | D-1 | 150.0 | | | 10.0 | 60 | | | | 200 | 8 | 180 |
| | | | | | D-9 | 25.0 | | | | | | | | | | |
| | | | | | W-1 | 15.0 | | | | | | | | | | |
| | | | | | M-1 | 105.0 | | | | | | | | | | |
| 21 | | | | | D-1 | 150.0 | | | 10.0 | 60 | | | | 200 | 8 | 180 |
| | | | | | D-10 | 25.0 | | | | | | | | | | |
| | | | | | W-1 | 15.0 | | | | | | | | | | |
| | | | | | M-1 | 105.0 | | | | | | | | | | |
| 22 | | | | | D-1 | 150.0 | | | 10.0 | 20 | | | 40 | 200 | 8 | 180 |
| | | | | | D-5 | 25.0 | | | | | | | | | | |
| | | | | | | | | | | | W-1 | 15.0 | | | | |
| | | | | | M-1 | 105.0 | | | | | | | | | | |
| 23 | | | | | D-1 | 150.0 | NOIGEN | 0.2 | 10.0 | 60 | | | 40 | 200 | 8 | 180 |
| | | | | | D-5 | 25.0 | TDS-200D | | | | | | | | | |
| | | | | | | | | | | | W-1 | 15.0 | | | | |
| | | | | | M-2 | 105.0 | | | | | | | | | | |
| 24 | | | | | D-1 | 150.0 | | | 10.0 | 20 | | | 40 | 200 | 8 | 150 |
| | | | | | D-5 | 25.0 | | | | | | | | | | |
| | | | | | W-1 | 15.0 | | | | | | | | | | |
| | | | | | | | | | | | M-1 | 75.0 | | | | |
| 25 | | | 1.0 | 1 | D-1 | 150.0 | | | 9.0 | 59 | | | | 200 | 8 | 120 |
| | | | | | D-5 | 25.0 | | | | | | | | | | |
| | | | | | W-1 | 15.0 | | | | | | | | | | |
| | M-3 | 130.0 | | | | | | | | | | | | | | |
| 26 | | | | | D-1 | 150.0 | | | 10.0 | 20 | | | 40 | 200 | 8 | 180 |
| | | | | | D-5 | 25.0 | | | | | | | | | | |
| | | | | | W-1 | 15.0 | | | | | | | | | | |
| | | | | | | | | | | | M-1 | 60.0 | | | | |
| 27 | | | 1.0 | 1 | D-1 | 150.0 | | | 9.0 | 59 | | | | 200 | 8 | 180 |
| | | | | | D-5 | 25.0 | | | | | | | | | | |
| | | | | | W-1 | 15.0 | | | | | | | | | | |
| | M-3 | 150.0 | | | | | | | | | | | | | | |
| 28 | | | | | D-1 | 80.0 | NOIGEN | 0.2 | 10.0 | 20 | D-1 | 70.0 | 40 | 200 | 8 | 180 |
| | | | | | D-5 | 25.0 | TDS-200D | | | | | | | | | |
| | | | | | W-1 | 15.0 | | | | | | | | | | |
| | | | | | M-1 | 60.0 | | | | | | | | | | |
| 30 | | | 5.0 | 1 | D-1 | 150.0 | | | 5.0 | 59 | | | | 200 | 8 | 180 |
| | | | | | D-5 | 25.0 | | | | | | | | | | |
| | | | | | W-1 | 15.0 | | | | | | | | | | |
| | M-1 | 105.0 | | | | | | | | | | | | | | |
| 31 | | | | | D-3 | 150.0 | | | 10.0 | 60 | | | | 200 | 8 | 180 |
| | | | | | D-5 | 25.0 | | | | | | | | | | |
| | | | | | W-1 | 15.0 | | | | | | | | | | |
| | | | | | M-1 | 105.0 | | | | | | | | | | |
| 32 | | | | | D-4 | 150.0 | | | 9.0 | 50 | | | | 200 | 8 | 180 |
| | | | | | D-5 | 25.0 | | | | | | | | | | |
| | | | | | W-1 | 15.0 | | | | | | | | | | |
| | | | | | M-1 | 105.0 | | | | | | | | | | |

Production Example of Magnetic Toner Particles 29

| | |
|---|---|
| Resin particle-dispersed solution D-1 (solid fraction 25.0% by mass) | 150.0 parts |
| Resin particle-dispersed solution D-5 (solid fraction 25.0% by mass) | 25.0 parts |
| Wax-dispersed solution W-2 (solid fraction 25.0% by mass) | 15.0 parts |
| Magnetic body-dispersed solution M-1 (solid fraction 25.0% by mass) | 105.0 parts |

The above materials were loaded into a beaker, adjusted to a total number of parts of water of 250 parts, and then adjusted to 30.0° C. Then, the materials were mixed by stirring for 10 min at 8000 rpm using a homogenizer (ULTRA TURRAX T50, manufactured by IKA Corporation).

Furthermore, 10.0 parts of 2.0% by mass aqueous solution of aluminum chloride was gradually added as a flocculant.

The raw material-dispersed solution was transferred to a polymerization kettle equipped with a stirrer and a thermometer, and was heated to 50.0° C. with a mantle heater and stirred to promote the growth of aggregated particles.

After 60 min had elapsed, the pH was adjusted to 5.4 by using a 0.1 mol/L sodium hydroxide aqueous solution, and then the aggregated particle-dispersed solution 29 was heated to 96.0° C. and allowed to stand for 180 min to coalesce the aggregated particles.

After 180 min, a toner particle-dispersed solution 29 in which toner particles were dispersed was obtained. After cooling at a temperature lowering rate of 1.0° C./min, the toner particle-dispersed solution 29 was filtered and washed with ion exchange water, and when the conductivity of the filtrate became 50 mS or less, the cake-shaped toner particles were removed.

Next, the cake-shaped toner particles were loaded in ion exchange water taken in an amount 20 times the mass of the toner particles and stirred by a three-one motor. When the toner particles were sufficiently loosened, re-filtration, washing with flowing water, and solid-liquid separation were performed. The resulting cake-shaped toner particles were pulverized in a sample mill and dried in an oven at 40° C. for 24 h. Further, the obtained powder was pulverized with a sample mill, and additional vacuum drying was performed in an oven at 40° C. for 5 h to obtain magnetic toner particles 29.

Production Examples of Magnetic Toners 2 to 32

Magnetic toners 2 to 32 were obtained in the same manner as in the Production Example of Magnetic Toner 1 except that the magnetic toner particles 1 were changed to magnetic toner particles 2 to 32.

The following results relating to the obtained magnetic toners 2-32 are shown in Table 6.

Number average particle diameter (Dn), average brightness at Dn [simply referred to as average brightness in the table], CV2/CV1, average value of occupied area ratio of magnetic body [denoted by A in the table], average circularity [referred to as circularity in the table], number average diameter of domains of crystalline polyester [denoted by B in the table], dielectric loss tangent, storage elastic modulus E'(85) at 85° C. in powder dynamic viscoelasticity measurement [simply denoted by E'(85) in the table], relationship [E'(40)−E'(85)]×100/E'(40) between the storage elastic modulus E'(40) at 40° C. in powder dynamic viscoelasticity measurement and E'(85) [denoted by C in the table], and amount (% by mass) of crystalline polyester (CPES).

TABLE 6

| | Toner No. | Dn (μm) | Circularity | Average brightness | CV2/CV1 | Dielectric loss tangent × $10^{-2}$ | E'(85) × $10^9$(Pa) | C | B (nm) | A (%) | CV3 | CPES amount |
|---|---|---|---|---|---|---|---|---|---|---|---|---|
| Example | 1 | 6.59 | 0.976 | 41.2 | 0.94 | 1.5 | 4.0 | 43 | 200 | 17.5 | 63.2 | 8.5 |
| | 2 | 6.57 | 0.976 | 43.1 | 0.91 | 1.5 | 5.2 | 32 | 180 | 21.3 | 76.1 | 3.6 |
| | 3 | 6.86 | 0.971 | 42.0 | 0.90 | 1.2 | 5.2 | 32 | 180 | 18.7 | 32.1 | 3.6 |
| | 4 | 6.85 | 0.975 | 41.0 | 0.98 | 1.5 | 2.3 | 68 | 230 | 19.4 | 74.8 | 14.3 |
| | 5 | 6.03 | 0.982 | 41.5 | 0.97 | 1.2 | 2.6 | 55 | 90 | 19.8 | 36.4 | 8.5 |
| | 6 | 6.79 | 0.981 | 48.7 | 0.89 | 1.1 | 5.2 | 32 | 180 | 16.3 | 43.0 | 3.6 |
| | 7 | 6.71 | 0.975 | 54.2 | 0.90 | 1.1 | 3.9 | 49 | 210 | 14.2 | 52.4 | 9.4 |
| | 8 | 6.35 | 0.980 | 42.6 | 0.92 | 2.0 | 4.1 | 41 | 200 | 18.2 | 66.2 | 8.5 |
| | 9 | 6.88 | 0.978 | 40.6 | 0.91 | 1.4 | 4.0 | 43 | 200 | 18.5 | 76.1 | 8.5 |
| | 10 | 6.41 | 0.977 | 43.3 | 0.89 | 1.2 | 4.0 | 43 | 200 | 23.6 | 42.0 | 8.5 |
| | 11 | 6.11 | 0.981 | 42.4 | 0.83 | 1.5 | 5.1 | 37 | 200 | 16.3 | 66.2 | 8.5 |
| | 12 | 6.76 | 0.971 | 41.1 | 0.86 | 1.5 | 2.1 | 68 | 280 | 23.4 | 64.7 | 18.2 |
| | 13 | 6.54 | 0.971 | 42.8 | 0.90 | 1.5 | 3.9 | 45 | 200 | 19.0 | 62.5 | 14.3 |
| | 14 | 6.41 | 0.983 | 37.6 | 0.89 | 1.5 | 4.0 | 44 | 200 | 38.7 | 63.0 | 8.5 |
| | 15 | 6.11 | 0.974 | 33.4 | 0.95 | 1.5 | 4.2 | 40 | 200 | 43.1 | 69.2 | 7.8 |
| | 16 | 6.49 | 0.971 | 40.2 | 0.88 | 1.6 | 4.1 | 41 | 450 | 15.2 | 67.4 | 8.5 |
| | 17 | 6.71 | 0.971 | 40.2 | 0.86 | 1.6 | 4.0 | 42 | 550 | 18.5 | 63.8 | 8.5 |
| | 18 | 6.14 | 0.961 | 43.2 | 0.85 | 1.5 | 4.1 | 41 | 200 | 17.7 | 62.2 | 8.5 |
| | 19 | 6.08 | 0.951 | 42.7 | 0.85 | 1.5 | 4.1 | 42 | 200 | 18.6 | 62.4 | 8.5 |
| | 20 | 6.59 | 0.981 | 42.4 | 0.85 | 1.5 | 3.8 | 46 | 200 | 19.2 | 63.2 | 8.5 |
| | 21 | 7.06 | 0.975 | 40.6 | 0.91 | 1.5 | 4.7 | 34 | 160 | 18.4 | 62.2 | 8.5 |
| | 22 | 6.91 | 0.975 | 40.6 | 0.99 | 1.5 | 4.0 | 42 | 200 | 18.4 | 62.2 | 8.5 |
| | 23 | 6.15 | 0.981 | 45.6 | 1.07 | 1.5 | 4.0 | 42 | 200 | 17.4 | 63.4 | 8.5 |
| | 24 | 6.82 | 0.981 | 54.2 | 0.83 | 1.5 | 4.0 | 43 | 200 | 16.7 | 70.4 | 9.4 |
| | 25 | 6.89 | 0.972 | 33.0 | 0.86 | 1.5 | 4.2 | 40 | 200 | 19.7 | 51.2 | 7.8 |
| | 26 | 6.85 | 0.978 | 60.5 | 0.90 | 1.5 | 4.0 | 43 | 200 | 11.5 | 73.5 | 10.0 |
| | 27 | 6.50 | 0.978 | 29.0 | 0.84 | 1.5 | 4.0 | 44 | 200 | 18.5 | 49.8 | 7.4 |
| C. E. | 28 | 6.89 | 0.972 | 64.2 | 0.92 | 0.9 | 4.0 | 33 | 200 | 13.3 | 43.5 | 10.0 |
| | 29 | 6.29 | 0.982 | 44.7 | 0.91 | 0.9 | 4.0 | 32 | 200 | 22.9 | 25.4 | 8.5 |
| | 30 | 6.64 | 0.982 | 44.7 | 0.97 | 1.1 | 4.0 | 31 | 200 | 17.1 | 92.1 | 8.5 |
| | 31 | 6.82 | 0.971 | 45.7 | 0.90 | 1.4 | 6.2 | 31 | 200 | 17.8 | 62.7 | 8.5 |
| | 32 | 6.71 | 0.983 | 44.2 | 0.93 | 1.4 | 3.2 | 29 | 200 | 18.0 | 62.7 | 8.5 |

C. E. denotes comparative example.

Examples 2 to 27 and Comparative Examples 1 to 5

The same evaluation as in Example 1 was performed using magnetic toners 2 to 32. The results are shown in Table 7.

TABLE 7

| | No. | Magnetic toner No. | Image density before repeated use | Difference in image density between before and after repeated use | Electrostatic offset | Fixing separability | Low-temperature fixability (speckling) | Low-temperature fixability (paper adhesion) |
|---|---|---|---|---|---|---|---|---|
| Example | 1 | 1 | A(1.52) | A(0.01) | A | A | A | A(145) |
| | 2 | 2 | C(1.36) | A(0.06) | C | A | A | C(170) |
| | 3 | 3 | A(1.54) | A(0.09) | C | C(5) | A | C(170) |
| | 4 | 4 | C(1.37) | C(0.17) | A | A | B | A(140) |
| | 5 | 5 | A(1.59) | C(0.19) | B | C(6) | B | A(140) |
| | 6 | 6 | C(1.35) | A(0.08) | C | C(5) | A | C(170) |
| | 7 | 7 | B(1.41) | A(0.04) | C | A | A | A(145) |
| | 8 | 8 | A(1.48) | A(0.07) | A | A | A | A(145) |
| | 9 | 9 | C(1.39) | A(0.05) | A | A | A | A(145) |
| | 10 | 10 | A(1.50) | A(0.08) | B | C(5) | A | A(145) |
| | 11 | 11 | A(1.48) | A(0.06) | C | A | A | C(160) |
| | 12 | 12 | A(1.48) | B(0.11) | B | C(4) | A | A(140) |
| | 13 | 13 | A(1.47) | A(0.06) | A | B(1) | A | A(140) |
| | 14 | 14 | A(1.50) | A(0.05) | A | B(2) | A | A(145) |
| | 15 | 15 | A(1.54) | A(0.07) | C | C(6) | A | B(150) |
| | 16 | 16 | A(1.49) | A(0.04) | A | A | A | B(150) |
| | 17 | 17 | B(1.44) | A(0.06) | A | A | B | C(160) |
| | 18 | 18 | A(1.52) | A(0.04) | A | B(2) | A | A(145) |
| | 19 | 19 | A(1.53) | A(0.03) | A | C(5) | A | A(145) |
| | 20 | 20 | A(1.53) | A(0.03) | A | A | A | A(145) |
| | 21 | 21 | A(1.52) | A(0.04) | A | A | A | A(145) |
| | 22 | 22 | A(1.47) | B(0.12) | A | A | A | A(145) |
| | 23 | 23 | A(1.46) | C(0.17) | A | A | A | A(145) |
| | 24 | 24 | B(1.43) | A(0.02) | A | A | A | A(145) |
| | 25 | 25 | A(1.57) | A(0.07) | B | B(2) | A | A(145) |
| | 26 | 26 | C(1.39) | A(0.01) | A | A | A | A(145) |
| | 27 | 27 | A(1.59) | A(0.08) | C | C(4) | A | A(145) |
| C. E. | 1 | 28 | D(1.34) | A(0.02) | D | A | A | A(145) |
| | 2 | 29 | A(1.51) | A(0.07) | D | D(8) | A | A(145) |
| | 3 | 30 | D(1.31) | C(0.15) | A | A | A | A(145) |
| | 4 | 31 | A(1.50) | A(0.05) | D | A | A | D(175) |
| | 5 | 32 | A(1.50) | A(0.07) | C | D(7) | D | A(145) |

C. E. denotes comparative example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-187459, filed Oct. 2, 2018, which is hereby incorporated by reference herein in its entirety.

What is claimed is:

1. A magnetic toner, comprising:

a magnetic toner particle that includes a binder resin, a magnetic body, and a crystalline polyester; and said toner having a dielectric loss tangent at 100 kHz of $1.0\times10^{-2}$ or more, wherein in cross-sectional observation of the magnetic toner particle using a transmission electron microscope TEM, a variation coefficient CV3 of an occupied area ratio of the magnetic body when a cross section of the magnetic toner particle is divided by a square grid having a side of 0.8 μm is 30 to 80.0%, and $E'(85)\leq5.5\times10^{9}$ and $[E'(40)-E'(85)]\times100/E'(40)\geq30$ when E'(40) [Pa] is a storage elastic modulus at 40° C. and E'(85) [Pa] is a storage elastic modulus at 85° C., the storage elastic moduli being obtained in a powder dynamic viscoelasticity measurement of the magnetic toner.

2. The magnetic toner according to claim 1, wherein an amount of the crystalline polyester in the magnetic toner is 15.0% by mass or less.

3. The magnetic toner according to claim 1, wherein an average value of the occupied area ratio of the magnetic body is 10 to 40.0%.

4. The magnetic toner according to claim 1, wherein a number average diameter of domains of the crystalline polyester present in a cross section of the magnetic toner particle observed with a transmission electron microscope is 50 to 500 nm.

5. The magnetic toner according to claim 1, wherein the magnetic toner has an average circularity of 0.960 or more.

6. The magnetic toner according to claim 1, wherein the crystalline polyester includes a monomer unit derived from an aliphatic diol having a carbon number of C2 to C12, and/or a monomer unit derived from an aliphatic dicarboxylic acid having a carbon number of C2 to C12.

7. The magnetic toner according to claim 1, wherein $E'(85)\leq5.0\times10^{9}$.

8. The magnetic toner according to claim 1, wherein $CV2/CV1\leq1.00$ when CV1(%) is a variation coefficient of a brightness dispersion value of the magnetic toner in a range from Dn−0.500 to Dn+0.500, CV2(%) is a variation coefficient of a brightness dispersion value of the magnetic toner in a range from Dn−1.500 to Dn−0.500, and Dn (μm) is a number average particle diameter of the magnetic toner, and an average brightness at the Dn of the magnetic toner is 30.0 to 60.0.

9. The magnetic toner according to claim 1, wherein the binder resin includes an amorphous polyester.

* * * * *